US010420451B2

(12) United States Patent
Hong et al.

(10) Patent No.: US 10,420,451 B2
(45) Date of Patent: Sep. 24, 2019

(54) DISHWASHER AND CONTROL METHOD THEREFOR

(71) Applicant: SAMSUNG ELECTRONICS CO., LTD., Suwon-si, Gyeonggi-do (KR)

(72) Inventors: Seung Gee Hong, Suwon-si (KR); Chang Wook Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/108,085

(22) PCT Filed: Dec. 29, 2014

(86) PCT No.: PCT/KR2014/012962
§ 371 (c)(1),
(2) Date: Jun. 24, 2016

(87) PCT Pub. No.: WO2015/102333
PCT Pub. Date: Jul. 9, 2015

(65) Prior Publication Data

US 2016/0324396 A1 Nov. 10, 2016

(30) Foreign Application Priority Data

Dec. 31, 2013 (KR) ..... 10-2013-0169290

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4221* (2013.01);
(Continued)

(58) Field of Classification Search
None
See application file for complete search history.

(56) References Cited

U.S. PATENT DOCUMENTS

2005/0133070 A1* 6/2005 Vanderroest ..... A47L 15/16 134/56 D
2009/0056754 A1 3/2009 Rolek
(Continued)

FOREIGN PATENT DOCUMENTS

CN 1552271 12/2004
CN 101095608 1/2008
(Continued)

OTHER PUBLICATIONS

Yamada Masahiko, Automatic Dishwasher, Jan. 26, 1999, JPH1119019A, entire document (Year: 1999).*
(Continued)

*Primary Examiner* — Jason Y Ko
*Assistant Examiner* — Cristi J Tate-Sims
(74) *Attorney, Agent, or Firm* — Staas & Halsey LLP

(57) ABSTRACT

A dishwashing machine is provided to include at least one spray part spraying washing water, a vane provided to be movable and deflecting the sprayed washing water, a rack accommodating tableware to be washed by the washing water deflected by the vane, a detection part detecting the tableware accommodated in the rack, and a controller generating position information with respect to the tableware detected by the detection part and controlling an operation of at least one of the at least one spray part and the vane based on the generated position information.

11 Claims, 22 Drawing Sheets

(52) U.S. Cl.
CPC ..... *A47L 2401/04* (2013.01); *A47L 2401/10* (2013.01); *A47L 2401/12* (2013.01); *A47L 2401/30* (2013.01); *A47L 2401/32* (2013.01); *A47L 2501/03* (2013.01); *A47L 2501/04* (2013.01); *A47L 2501/20* (2013.01)

(56) References Cited

U.S. PATENT DOCUMENTS

| | | | | |
|---|---|---|---|---|
| 2009/0071508 | A1 | 3/2009 | Sundaram et al. | |
| 2013/0319487 | A1* | 12/2013 | Hong | A47L 15/06 134/183 |
| 2016/0000297 | A1* | 1/2016 | Hodapp, Jr. | A47L 15/44 134/18 |

FOREIGN PATENT DOCUMENTS

| | | | | |
|---|---|---|---|---|
| CN | 103462574 | | 12/2013 | |
| EP | 1 488 730 | | 12/2004 | |
| EP | 2 030 556 | | 3/2009 | |
| EP | 2030556 | A1 * | 3/2009 | A47L 15/00 |
| EP | 2 510 863 | | 10/2012 | |
| EP | 2 671 494 | | 12/2013 | |
| EP | 2888984 | A1 * | 7/2015 | A47L 15/0049 |
| JP | H1119019 | A | 1/1999 | |
| KR | 1019970005225 | * | 2/1997 | A47L 15/00 |
| KR | 1001441590000 | | 4/1998 | |
| KR | 1001602450000 | | 8/1998 | |
| WO | 92/12665 | | 8/1992 | |
| WO | WO 2015/102333 | A1 | 7/2015 | |

OTHER PUBLICATIONS

Written Opinion (Form PCT/ISA/237); dated Aug. 4, 2015 in corresponding International Application No. PCT/KR2014/012962 (11 pages) (16 pages English Translation).
International Search Report (Form PCT/ISA/210); dated Apr. 8, 2015 in corresponding International Application No. PCT/KR2014/012962 (3 pages) (2 pages English Translation).
Extended European Search Report dated Jul. 25, 2017 in corresponding European Patent Application No. 14876398.0, 6 pages.
Chinese Office Action dated Jun. 5, 2018 from Chinese Patent Application No. 201480075543.8, 23 pages.
European Office Action dated Oct. 29, 2018 from European Patent Application No. 14876398.0, 5 pages.
Annex to European Office Action from European Patent Application No. 14876398.0, 2 pages.
Chinese Office Action dated Feb. 15, 2019 from Chinese Patent Application No. 201480075543.8, 21 pages.

* cited by examiner

DISHWASHER AND CONTROL METHOD THEREFOR

CROSS-REFERENCE TO RELATED APPLICATIONS

This application is a U.S. national stage application of PCT international application PCT/KR2014/012962, filed on Dec. 29, 2014 and claims the benefit of Korean Patent Application No. 10-2013-0169290, filed on Dec. 31, 2013, respectively, the contents are incorporated herein by reference.

BACKGROUND

1. Technical Field

Disclosed herein relates to a dishwashing machine and a method of controlling the same, and to a dishwashing machine spraying tableware stored inside a washing tub with washing water, and a method of controlling the same.

2. Background Art

Generally, a dishwashing machine is a machine for eliminating contaminants (food scraps and the like) on tableware therefrom by spraying the tableware with cold or hot washing water at a high pressure.

Such a dishwashing machine supplies the washing water inside a washing tub when a washing is commenced, and then sprays the supplied washing water at a high pressure. As described above, the dishwashing machine washes the tableware through the sprayed washing water at a high pressure.

In other words, the dishwashing machine sprays the tableware with the washing water to eliminate contaminants on the tableware therefrom, wherein the tableware is accommodated inside the washing tub.

SUMMARY

An object is to provide a dishwashing machine capable of detecting a zone at which tableware is accommodated inside a washing tub, and a method of controlling the same.

To address the problems described above, a dishwashing machine and a method of controlling the same are provided.

For this purpose, a dishwashing machine may include at least one spray part configured to spray washing water, a vane provided to be movable and configured to deflect the sprayed washing water, a rack configured to accommodate tableware to be washed by the washing water deflected by the vane, a detection part configured to detect the tableware accommodated in the rack, and a controller configured to generate position information with respect to the tableware detected by the detection part and control an operation of at least one of the at least one spray part and the vane based on the generated position information.

Also, the detection part may include a light detector installed at the vane and configured to receive light irradiated from a light emitter or reflected by the tableware. At this point, the controller may generate the position information that the tableware is accommodated at a position at which an amount of the light irradiated from the light emitter is equal to or greater than a reference amount of light, or that the tableware is accommodated at a position at which an amount of the light reflected by the tableware is equal to or greater than a reference amount of light, wherein the amount of the light is detected by the light detector. In addition, the controller may generate an image of the rack based on the amount of the light detected by the light detector, and the position information that the tableware is accommodated at a position at which the generated image and a reference image are different from each other.

Additionally, the detection part may include an ultrasonic detector installed at the vane and configured to detect an ultrasonic wave irradiated from an ultrasonic emitter or reflected by the tableware. At this point, the controller may generate the position information by comparing the ultrasonic wave detected by the ultrasonic detector with a reference ultrasonic wave.

Meanwhile, the vane may further include a reflector configured to reflect and deliver light or an ultrasonic wave to the detection part installed inside a washing tub. Here, the reflector may have a curvature so as to reflect the light or the ultrasonic wave being incident toward the detection part.

Moreover, when the detection part detects the tableware being accommodated, the controller may generate the position information that the tableware is accommodated at a position of the rack, wherein the position corresponds to a position of the vane.

Further, the dishwashing machine may further include a temperature sensor configured to measure temperature of the washing water, and the controller may control movement of the vane based on a variation of the measured temperature.

Also, the dishwashing machine may further include a turbidity sensor configured to measure turbidity of the washing water, and the controller may control movement of the vane based on the turbidity of the washing water. At this point, the controller may determine a contamination degree of the tableware depending on the turbidity of the washing water, and decide a moving speed of the vane in response to the contamination degree.

In addition, the controller may control the movement of the vane based on the position information so as to enable the sprayed washing water to be deflected toward a position at which the tableware is accommodated.

Additionally, the controller may determine a spray part to spray the washing water of the at least one spray part based on the position information.

For this purpose, a method of controlling a dishwashing machine may include detecting tableware accommodated in a rack to generate position information, wherein the rack accommodates the tableware, and controlling an operation of at least one of at least one spray part configured to spray washing water and a vane provided to be movable and configured to deflect the sprayed washing water based on the position information, thereby washing the tableware.

At this point, the generating of the position information may include sensing light or an ultrasonic wave while moving together with the vane, and detecting an accommodation status of the tableware based on the sensed light or the sensed ultrasonic wave.

Here, the position information may be generated that the tableware is accommodated at a position corresponding the vane when the accommodation status of the tableware is detected.

Meanwhile, the generating of the position information may include sensing the light or the ultrasonic wave reflected by a reflector provided at the vane, and detecting an accommodation status of the tableware based on the sensed light or the sensed ultrasonic wave and generating the position information that the tableware is accommodated at a position corresponding to the vane when the accommodation status is detected.

Also, the washing of the tableware may include collecting information of the washing water according to a position of the vane, and deciding a moving speed of the vane based on the information of the washing water. At this point, the information of the washing water may be at least one of temperature of the washing water and turbidity thereof.

In addition, the washing of the tableware may further include moving the vane based on the position information so as to enable the sprayed washing water to be deflected toward a position at which the tableware is accommodated.

Additionally, the washing of the tableware may further include determining a spray part to spray the washing water of the at least one spray part based on the position information.

In accordance with the dishwashing machine and the method of controlling the same described above, washing water may be intensively sprayed toward a position at which tableware is accommodated.

DESCRIPTION OF EMBODIMENTS

Hereinafter, preferred embodiments according to the present disclosure will be described in detail.

Figure 1:
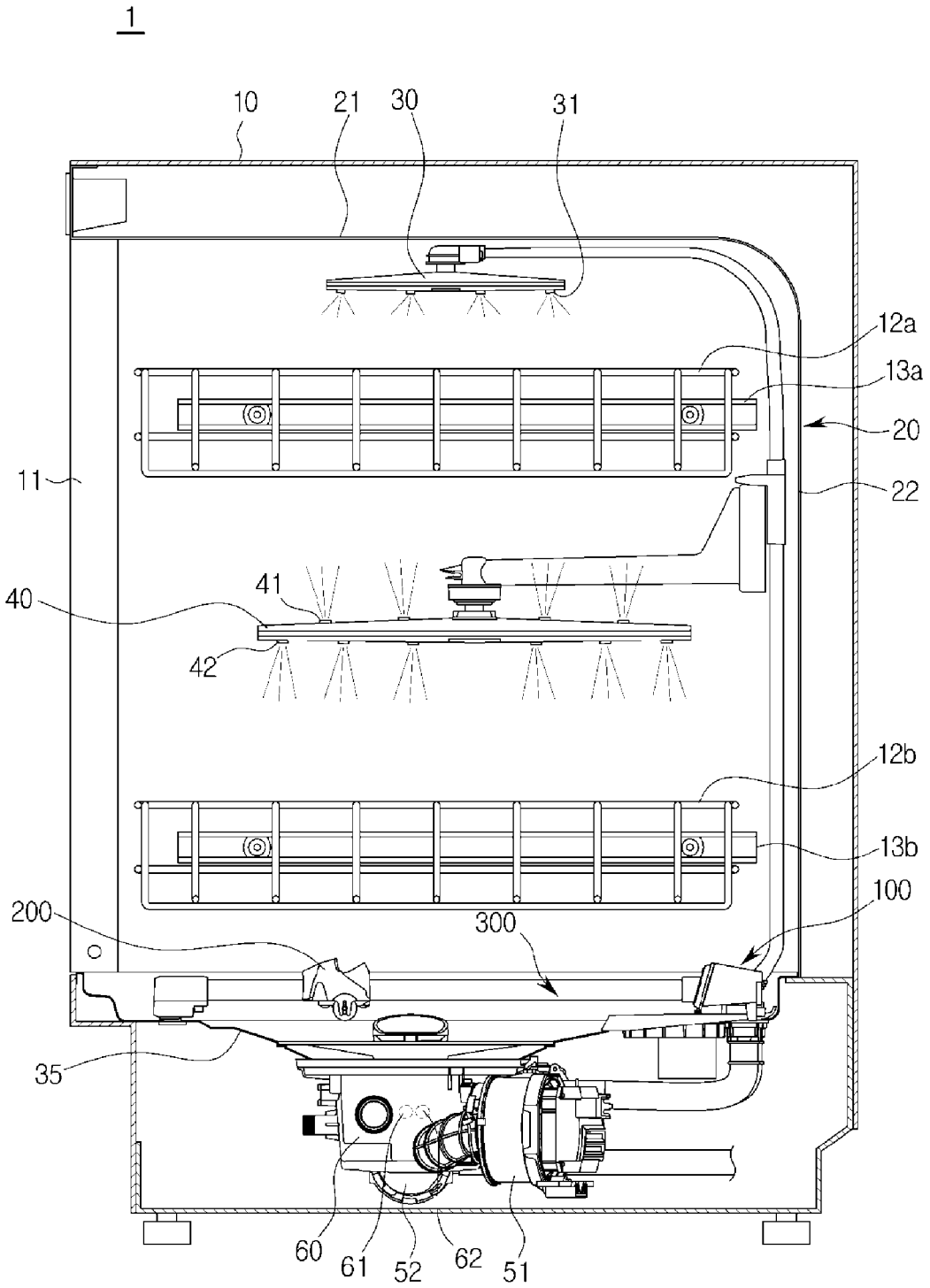
FIG. 1 is a schematic cross-sectional diagram illustrating a dishwashing machine according to one embodiment.
Figure 2:
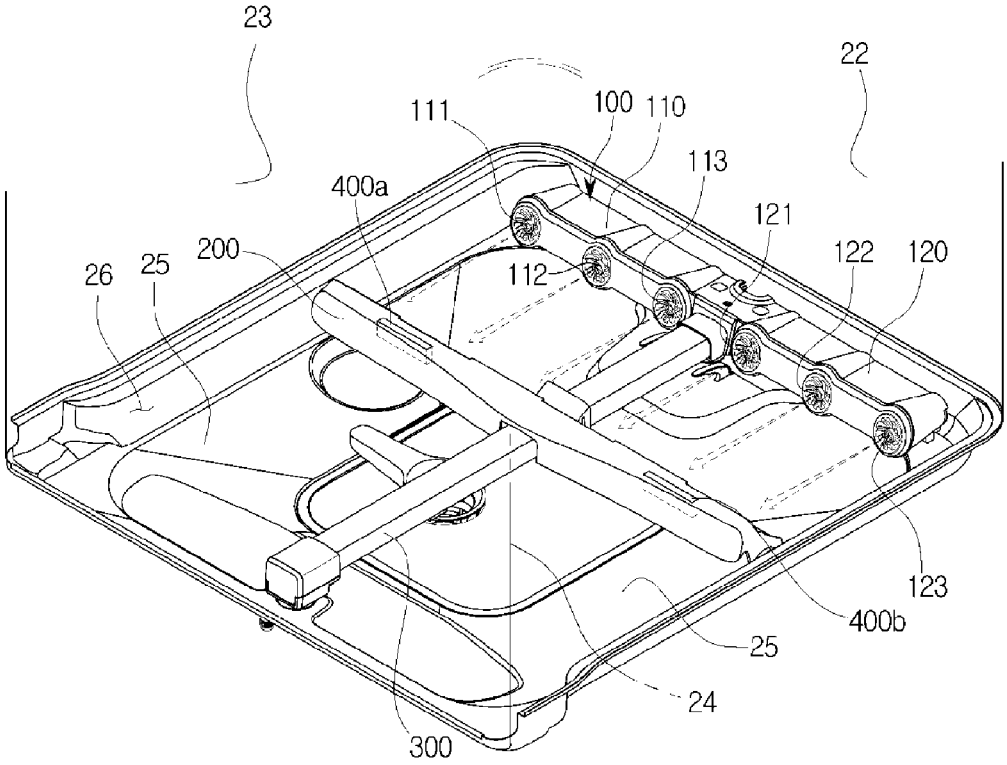
FIG. 2 is a diagram illustrating a lower portion of the dishwashing machine according to one embodiment.

FIG. 1 is a schematic cross-sectional diagram illustrating a dishwashing machine according to one embodiment. FIG. 2 is a diagram illustrating a lower portion of the dishwashing machine according to one embodiment.

With reference to FIGS. 1 and 2, an entire structure of a dishwashing machine 1 according to one embodiment will be generally described.

The dishwashing machine 1 includes a main body 10 constituting an external appearance, a washing tub 20 provided inside the main body 10, racks 12*a* and 12*b* provided inside the washing tub 20 to accommodate tableware, spray parts 30, 40, and 100 spraying washing water, a sump 60 storing the washing water, a circulator 51 pumping the washing water in the sump 60 to supply it to the spray parts 30, 40, and 100, a drain 52 discharging the washing water in the sump 60 together with waste to an external side of the main body 10, a vane 200 moving inside the washing tub 20 to deflect the washing water toward the tableware, and a vane driver 300 driving the vane 200.

The washing tub 20 may have an approximate polyhedral box shape of which a front portion is opened so as to enable the tableware to be put in and taken out. A front opening of the washing tub 20 may be opened and closed by a door 11. The washing tub 20 may include an upper wall 21, a rear wall 22, a left wall 23, a right wall 24, and a bottom plate 35.

The rack 12 may be provided inside the washing tub 20, and may include a first rack 12*a* disposed at an upper portion of the washing tub 20 and a second rack 12*b* disposed at a lower portion of the washing tub 20. At this point, the racks 12*a* and 12*b* may be a wire rack that is made of wires in the form of a grid so as to allow the washing water to pass therethrough without stagnating.

A slide rail 13*a* includes a first slide rail 13*a* movably supporting the first rack 12*a* and a second slide rail 13*b* movably supporting the second rack 12*b*.

In particular, the first rack 12*a* is installed at the upper portion inside the washing tub 20 to be movable forward and backward through the first slide rail 13*a*, and the second rack 12*b* is installed at the lower portion of the tub 20 to be movable forward and backward through the second slide rail 13*b*. As described above, the first rack 12*a* and the second rack 12*b* are installed to be movable forward and backward so that a user may draw the first rack 12*a* or the second rack 12*b* to put the tableware in or take it out of the first rack 12*a* or the second rack 12*b* through a front surface of the washing tub 20.

The dishwashing machine 1 sprays the washing water at a high pressure to wash the tableware. For this purpose, the plurality of spray parts 30, 40, and 100 may be provided at the dishwashing machine. For example, the dishwashing machine 1 may include an upper rotary spray part 30, a middle rotary spray part 40, and a linear spray part 100.

The upper rotary spray part 30 may be provided at an upper side of the first rack 12*a* to spray washing water downwardly while rotating by water pressure. For this purpose, a plurality of spray holes 31 may be provided at a lower end of the upper rotary spray part 30. Therefore, the upper rotary spray part 30 may directly spray the tableware accommodated in the first rack 12*a* with washing water through the plurality of spray holes 31. At this point, the plurality of spray holes 31 may slantly spray the washing water, and the upper rotary spray part 30 may rotate in reaction to the sprayed washing water.

The middle rotary spray part 40 may be provided between the first rack 12*a* and the second rack 12*a* to spray the washing water upwardly and downwardly while rotating by water pressure. For this purpose, the middle rotary spray part 40 may be provided with a plurality of upper spray holes 41 and a plurality of lower spray holes 42. At this point, the plurality of upper spray holes 41 or the plurality of lower spray holes 42 may slantly spray the washing water, and the middle rotary spray part 40 may rotate in reaction to the sprayed washing water.

The linear spray part 100 sprays the washing water in a direction of the vane 200. At this point, the washing water sprayed toward the vane 200 may be sprayed in a direction of the tableware by the vane 200. Such a linear spray part 100 may be provided at any position inside the washing tub 20. For example, as shown in FIG. 1, the linear spray part 100 may be disposed approximately adjacent to the rear wall 22 of the washing tub 20 to spray the washing water toward the front of the washing tub 20.

Also, the linear spray part 100 may be provided with a plurality of linear spray parts 100. For example, as shown in FIG. 2, the linear spray part 100 may include a left linear spray part 110 disposed on a left side of the washing tub 20 and a right linear spray part 120 disposed on a right side of the washing tub 20.

At this point, the left linear spray part 110 may be provided with a plurality of fixed spray holes 111, 112, and 113 disposed on left and right directions, and the fixed spray holes 111, 112, and 113 provided at the left linear spray part 110 may spray the washing water in a left direction of the vane 200. Also, the right linear spray part 120 may be provided with a plurality of fixed spray holes 121, 122, and 123 disposed on the left and right directions, and the fixed spray holes 121, 122, and 123 provided at the right linear spray part 120 may spray the washing water in a right direction of the vane 200.

Meanwhile, the linear spray part 100 is shown in FIGS. 1 and 2 as being located at the lower side, but it is not limited thereto, and it may be provided at a position of the upper rotary spray part 30 or the middle rotary spray part 40.

The vane 200 may deflect the washing water sprayed from the linear spray part 100 in a direction of the rack 12 in which the tableware is accommodated. For example, as shown in FIG. 1, the vane 200 may deflect the washing water sprayed from the linear spray part 100 toward the upper side. In other words, the washing water sprayed from the linear spray part 100 may be deflected toward the tableware accommodated in the second rack 12*a* by the vane 200.

Consequently, the vane 200 may lengthily extend in the left and right directions of the washing tub 20 so as to deflect all the washing water sprayed from the plurality of spray holes 111, 112, 113, 121, 122, and 123 of the linear spray part 100. That is, one end of the vane 200 in a length direction may be provided adjacent to the left wall 23 of the washing tub 20, and the other end thereof in the length direction may be provided adjacent to the right wall 24 of the washing tub 20.

In addition, a plurality of supporters 25 may be provided at both ends of the lower end of the washing tub 20 to support the vane 200 along a movement direction of the vane 200. At this point, the vane 200 may maintain level through the plurality of supporters 25.

The vane driver 300 may make the vane 200 perform a reciprocating movement along a spray direction of the washing water sprayed from the linear spray part 100. That is, the vane 200 may perform a reciprocating movement along forward and backward directions of the washing tub 20. The vane driver 300 will be described in detail below.

Therefore, a linear spray structure including such a linear spray part 100 and such a vane 200 can wash all zones of the washing tub 20 with no dead zones. In other words, it is differentiated in that the rotary spray parts 30 and 40 may spray the washing water only within a range of a rotation radius.

Meanwhile, the vane 200 will be described below to linearly perform a reciprocating movement between the front (a direction of the door) of the washing tub 20 and the rear wall 22, but it is not limited thereto, and it should be understood that a direction of a linear reciprocating movement may be altered depending on a position at which the linear spray part 100 is provided.

A detection part 400 may detect a zone at which the tableware is accommodated inside the washing tub 20. At this point, the detection part 400 may be provided inside the washing tub 20, and, according to one embodiment, it may be provided at one side of the vane 200 to be movable as shown in FIG. 2. As described later, detectors 400*a* and 400*b* may be provided in plural numbers at an upper side of the vane 200 to exactly detect a position at which the tableware is accommodated in the rack 12. At this point, the detection part 400 may detect an accommodation status of the tableware through various methods, and a method using light or an ultrasonic wave for detecting the accommodation status of the tableware will be described below.

The sump 60 accommodates the washing water sprayed by the rotary spray parts 30 and 40, or the linear spray part 100. A temperature sensor 61 for sensing temperature of the accommodated washing water or a turbidity sensor 62 for sensing turbidity of the washing water may be provided inside the sump 60.

The circulator 51 supplies the washing water accommodated inside the sump 60 to the rotary spray parts 30 and 40 or the linear spray part 100 at a high pressure, the washing water supplied at a high pressure is sprayed toward the tableware through the rotary spray parts 30 and 40 or the linear spray part 100, and the sprayed washing water is again accommodated in the sump 60. At this point, the circulator 51 may include a circulation pump for supplying the washing water at a high pressure. As described above, the washing water is circulated inside the washing tub 20 through the circulator 51 to wash the tableware, and is discharged to the external side of the dishwashing machine 1 through the drain 52 when each cycle including a washing cycle, a rinsing cycle and the like is completed. At this point, the drain 52 may include a drain pump for discharging the washing water to the external side of the dishwashing machine.

Hereinafter, a major configuration of the dishwashing machine 1 according to one embodiment of the present disclosure will be described in detail one at a time.

Figure 3:
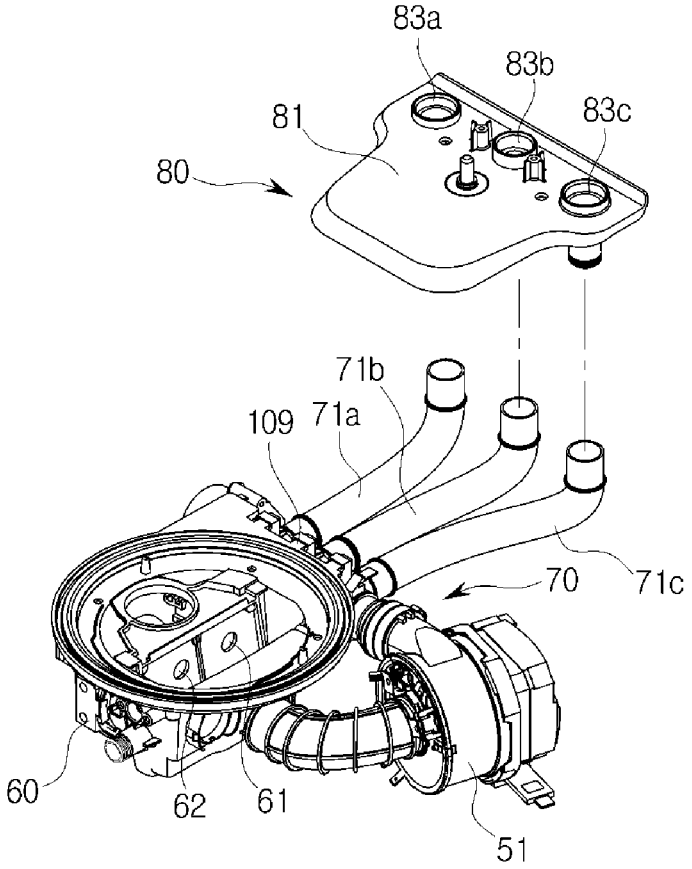
FIG. 3 is an exploded diagram of a lower end of the dishwashing machine for describing a passage structure of the dishwashing machine according to one embodiment.
Figure 4:
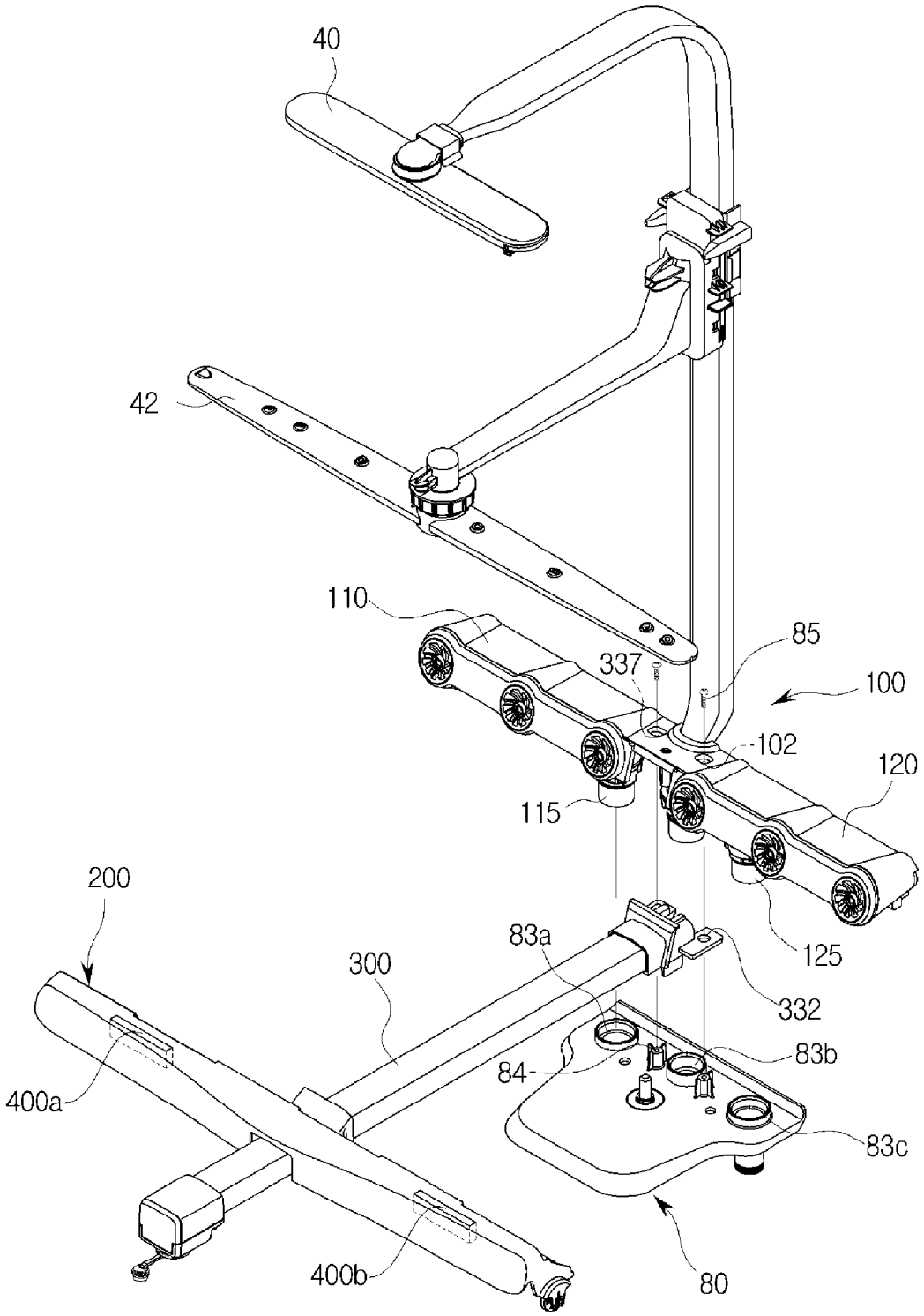
FIG. 4 is an exploded diagram for describing a spray part and a vane of the dishwashing machine according to one embodiment.

FIG. 3 is an exploded diagram of a lower end of the dishwashing machine for describing a passage structure of the dishwashing machine according to one embodiment. FIG. 4 is an exploded diagram for describing the spraying part and the vane of the dishwashing machine according to one embodiment.

With reference to FIGS. 3 and 4, a passage structure of the dishwashing machine according to one embodiment will be described in detail.

A distributor 70 may distribute the washing water of a high pressure pumped by the circulator 51. The distributor 70 may be connected to a first hose 71*a* supplying the washing water of a high pressure to the left linear spray part 110, a second hose 71*c* supplying the washing water of a high pressure to the right linear spray part 120, and a third hose 71*b* supplying the washing water of a high pressure to the rotary spray parts 30 and 40.

A bottom plate cover 80 may include a plurality of connectors 83*a*, 83*b*, and 83*c* for connecting the hoses extending from the distributor 70 to washing water inlets of the spray parts, and a plurality of coupling holes 84*a* and 84*b* for coupling the plurality of spray parts 30, 40, and 100 to the vane driver 300, and the plurality of spray parts 30, 40, and 100, the vane driver 300, and the bottom plate cover 80 may be firmly fixed to each other through a coupling member 85.

At this point, the first hose 71*a* may be connected to a washing water inlet 115 of the left linear spray part 110 through a first connector 83*c* to form a passage between the left linear spray part 110 and the distributor 70, the second hose 71*c* may be connected to a washing water inlet 125 of the right linear spray part 120 through a second connector 83*c* to form a passage between the right linear spray part 120 and the distributor 70, and the third hose 71*b* may be connected to the rotary spray parts 30 and 40 through a third connector 83*b* to form a passage between the rotary spray parts 30 and 40 and the distributor 70.

Consequently, the rotary spray parts 30 and 40 and the linear spray part 100 may independently spray the washing water. In addition, the left linear spray part 110 and the right linear spray part 120 may independently spray the washing water.

Figure 5:
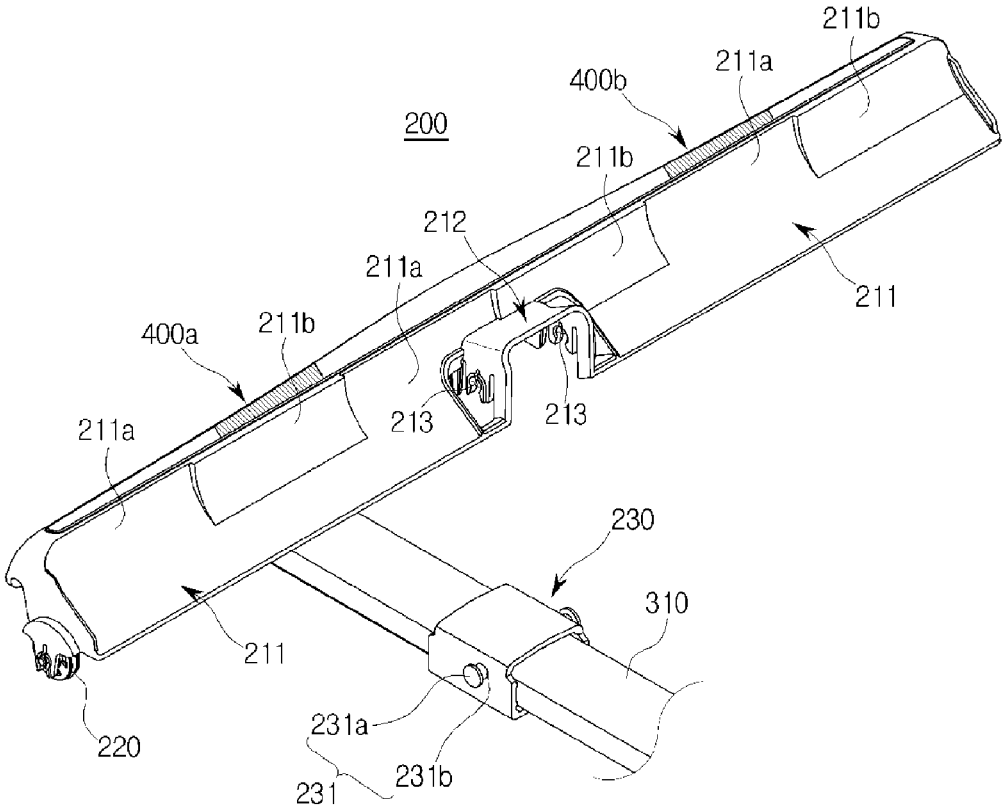
FIG. 5 is a magnified diagram of the vane for describing the vane of the dishwashing machine according to one embodiment in detail.

FIG. 5 is a magnified diagram of the vane for describing the vane of the dishwashing machine according to one embodiment in detail. Hereinafter, with reference to FIG. 5, the vane 200 deflecting the washing water sprayed from the linear spray part 100 will be described in detail.

The vane 200 may be provided to extend lengthily in a vertical direction with respect to a rail 310.

The vane 200 may include a washing water deflector 211 deflecting the washing water sprayed from the linear spray part 100, a cap 212 provided at a center position in a length direction of the washing water deflector 211, and a coupling depression 405 at which a vane holder 230 and the vane 200 are coupled to each other.

The washing water deflector 211 may include a first deflection surface 211*a* and a second deflection surface 211*b* which are provided to be inclined to deflect the washing water. At this point, the first deflection surface 211*a* and the second deflection surface 211*b* may have different inclines from each other and may be alternately disposed in the length direction. As described above, the inclines of the first deflection surface 211*a* and the second deflection surface 211*b* are different from each other so that the vane 200 may deflect the washing water in various directions.

A coupling depression 213 for coupling to the vane holder 230 may be provided at the cap 212 to couple the vane 200 to a coupling protrusion 231 of the vane holder 230. At this point, the coupling protrusion 231 may include a coupling shaft 231*a* protruding in a lateral direction and an escape preventer 231*b* formed at an end of the coupling shaft 231*a* so as to prevent an escape of the vane.

Rollers 220 smoothing movement of the vane 200 may be provided at both ends of the vane 200 in the length direction thereof. At this point, the rollers 220 come in contact with a supporter 36 provided at the bottom plate 35 of the washing tub 20 to make the vane 200 maintain level, thereby smoothing the movement of the vane 200.

Meanwhile, the detection part 400 may be provided at an upper side of the vane 200. A sensor part 530 senses an accommodation position of the tableware in the rack 12, and it will be described in detail below.

Figure 6:
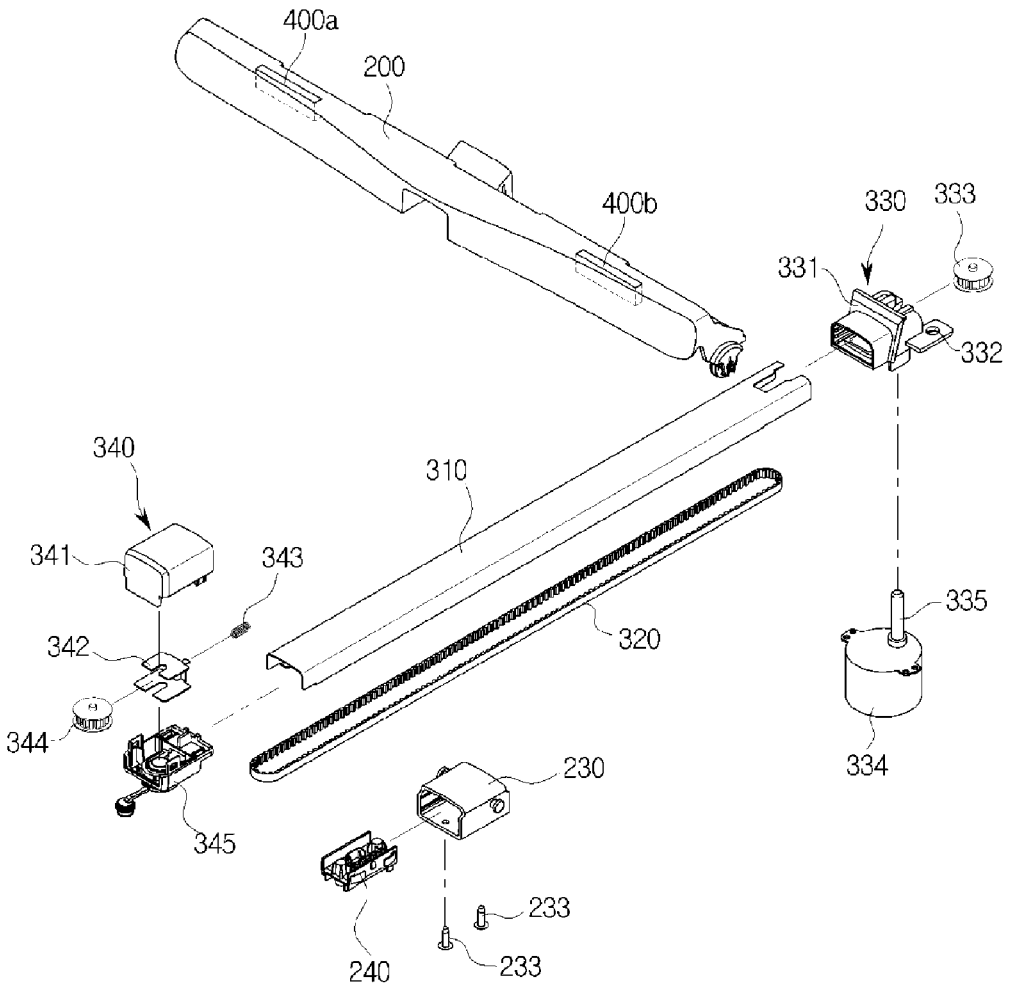
FIG. 6 is an exploded diagram of a vane driver for describing the vane driver according to one embodiment in detail.
Figure 7:
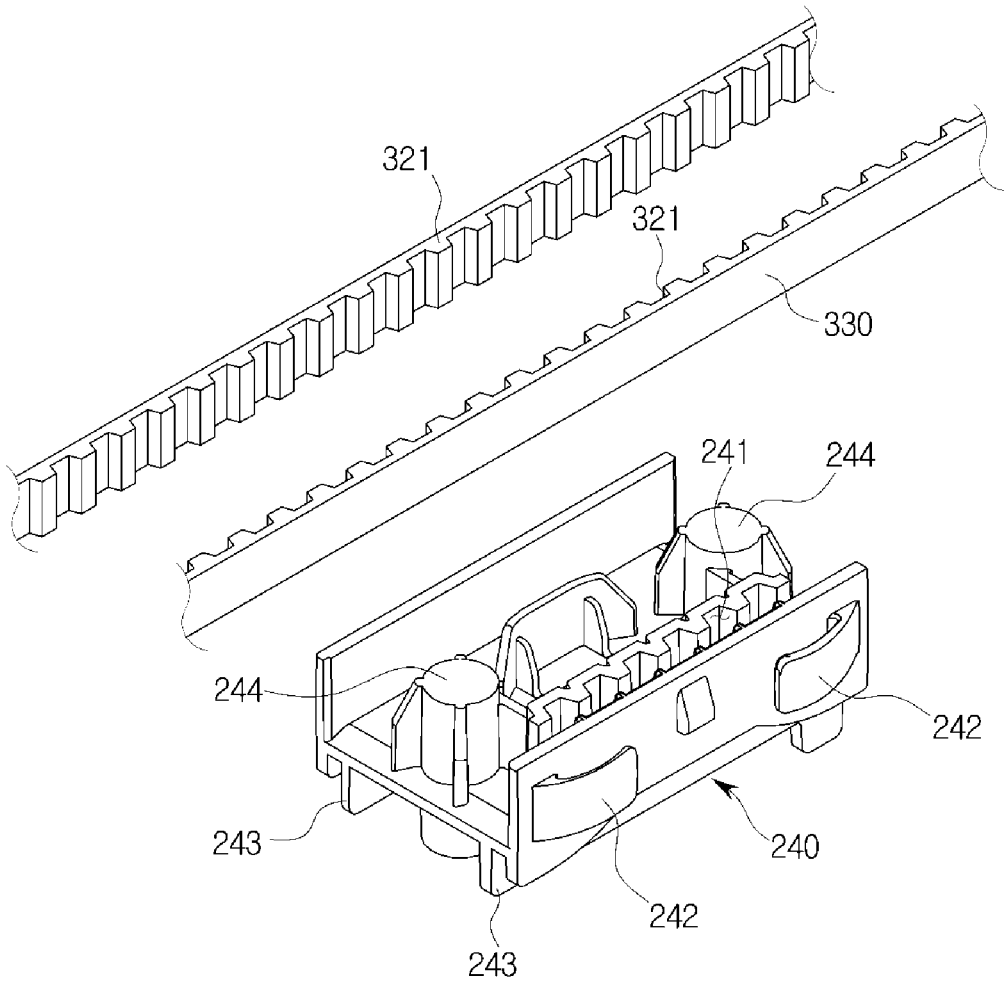
FIG. 7 is a magnified diagram illustrating a belt and a belt holder of the vane driver according to one embodiment in detail.

FIG. 6 is an exploded diagram of the vane driver 300 for describing the vane driver 300 according to one embodiment in detail. FIG. 7 is a magnified diagram illustrating a belt 320 and a belt holder 240 of the vane driver 300 according to one embodiment in detail.

The vane driver 300 may cause the vane 200 to perform a linear reciprocating along a direction of the washing water sprayed from the linear spray part 100. The vane driver 300 may include the rail 310 guiding the movement of the vane 200 and having an inner space, the belt 320 provided inside the rail 310, a drive holder 330 connected to and driving the belt 320, and a driven holder 340 connected to the belt 320. At this point, the vane 200 and the vane driver 300 may be coupled to each other through the vane holder 230.

The rail 310 may be formed of a metal material. The rail 310 may be provided to extend lengthily in the front and rear directions on a center position based on the left wall 23 and the right wall 24 of the washing tub 20.

The rail 310 may have a tube shape in which an opening is formed approximately at a lower portion. The opening at the lower portion of the rail 310 may extend from one end of the rail 310 in a length direction thereof to the other end thereof. As described above, the belt 320 is disposed at the inner space of the rail 310 so that it may prevent the belt 320 from being interfered with the tableware of the washing tub 20 by coming in contact therewith, or from being corroded by coming in contact with the washing water of the washing tub 20.

The belt 320 may be provided inside the rail 310. The belt 320 provided inside the rail 310 may form a closed curve by being wound around a driven pulley 344 provided inside the driven holder 340 and a drive pulley 333 provided inside the drive holder 330. Therefore, if a motor 334 coupled to the drive pulley 333 is driven, the belt 320 may be rotationally moved in a rotational direction of the motor 334. Such a belt 320 may be made of a resin material containing an aramid fiber in consideration of tensile strength and cost.

Teeth 321 may be formed on an inner lateral surface of the belt 320 to deliver a driving force to the belt holder 240.

Like the belt 320, the belt 320 holder 240 may be disposed at the inner space of the rail 310 and engaged with the teeth 321 of the belt 320, thereby moving together with the belt 320. For this purpose, the belt 320 holder 240 may have a teeth coupler 241 to be engaged with the teeth 321.

Also, the belt holder 240 may include legs 243 supported by the rail 310. The legs 243 may include at least one lateral leg 242 that protrudes laterally to be supported by a lateral wall of the rail 310, and at least one lower leg 243 that protrudes downwardly to be supported by a lower wall of the rail 310.

The lateral legs 242 may be provided to be elastically deformable so as to reduce noise and vibration due to collision and friction between the belt holder 240 and the rail 310 while the belt holder 240 moves, and to enable the belt holder 240 to be smoothly moved.

The lateral legs 242 may be an elastic body of a kind of a plate spring. In other words, the lateral legs 242 may include a curved plate being elastically deformable between a relaxation shape and a compression shape.

Also, the belt holder 240 may have a coupler 244 for coupling to the vane holder 230. A hole into which a coupling member is inserted may be provided at a lower surface of the coupler 244.

The vane holder 230 is coupled to the belt holder 240 and moves together therewith to deliver the driving force of the belt holder 240 to the vane 200. The vane holder 230 is provided to surround an outer lateral surface of the rail 310.

The vane holder 230 is coupled to the belt holder 240 through a lower opening of the rail 310. For this purpose, the vane holder 230 may have a hole for coupling to the belt holder 240. A drive holder may include a holder housing 331 for accommodating the drive pulley, the motor rotating the belt based on the rotation force of the belt and the motor, and the motor generating a rotational force.

At this point, the drive pulley 333 may be rotatably accommodated inside the drive holder 330, and a shaft connector may be provided at a lower end of the drive pulley 333 to be connected to a drive shaft 335 of the motor 334, thereby receiving a driving force.

The motor 334 generates a rotational force for moving the vane 200. In particular, when the rotational force generated by the motor 334 is delivered to the drive pulley 333 through the drive shaft 335, the belt 320 coupled to the drive pulley 333 is rotated while the drive pulley 333 rotates. As described above, if the belt 320 is rotated, the belt holder 240 coupled to the belt 320 and the vane holder 230 coupled to the belt holder 240 are linearly moved.

At this point, the motor 334 may employ a direct current (DC) motor, an alternating current (AC) motor, or a stepping motor which are bidirectionally rotatable clockwise and counterclockwise. However, it is not limited thereto.

The driven holder 340 includes a driven top holder 341, a driven bottom holder 345 coupled to a lower portion of the driven top holder 341, and a pulley bracket 342 provided to be movable along the length direction of the rail 310 between the driven top holder 341 and the driven bottom holder 345 and rotatably supporting the driven pulley 344. At this point, the front bottom holder 345 may be coupled to the lower portion of the front top holder 341 by a locking structure, and may further include a coupling protrusion for coupling to the bottom plate 35 of the washing tub 20.

Meanwhile, the rail 310, the belt 320, the drive pulley 333, and the driven pulley 344 may be mutually assembled by tension of the belt 320.

Figure 8:
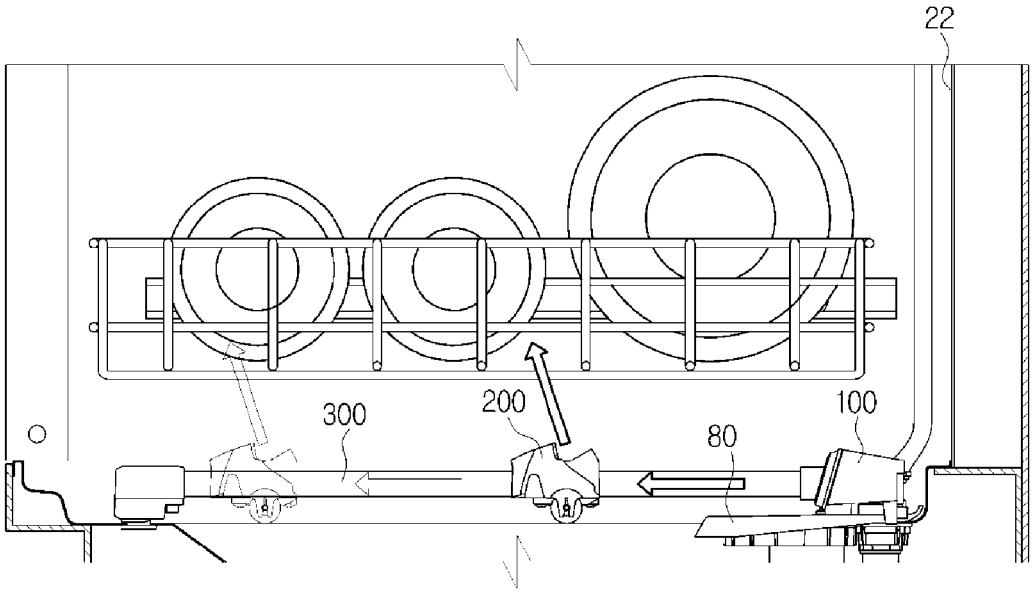
FIG. 8 is a diagram illustrating an operation of deflecting washing water by the vane according to one embodiment.

FIG. 8 is a diagram illustrating an operation of deflecting the washing water by the vane 200 according to one embodiment. As described above, the vane 200 may be moved along the spray direction of the washing water of the linear spray part 100 by the vane driver 300.

Therefore, the washing water sprayed from the linear spray part 100 is deflected toward the upper portion by the deflection surface of the vane 200 to be sprayed toward the tableware accommodated in the second rack 12*a*. At this point, while moving by the vane driver 300, the vane 200 may uniformly spray the tableware accommodated in the second rack 12*a* with the washing water.

Figure 9:
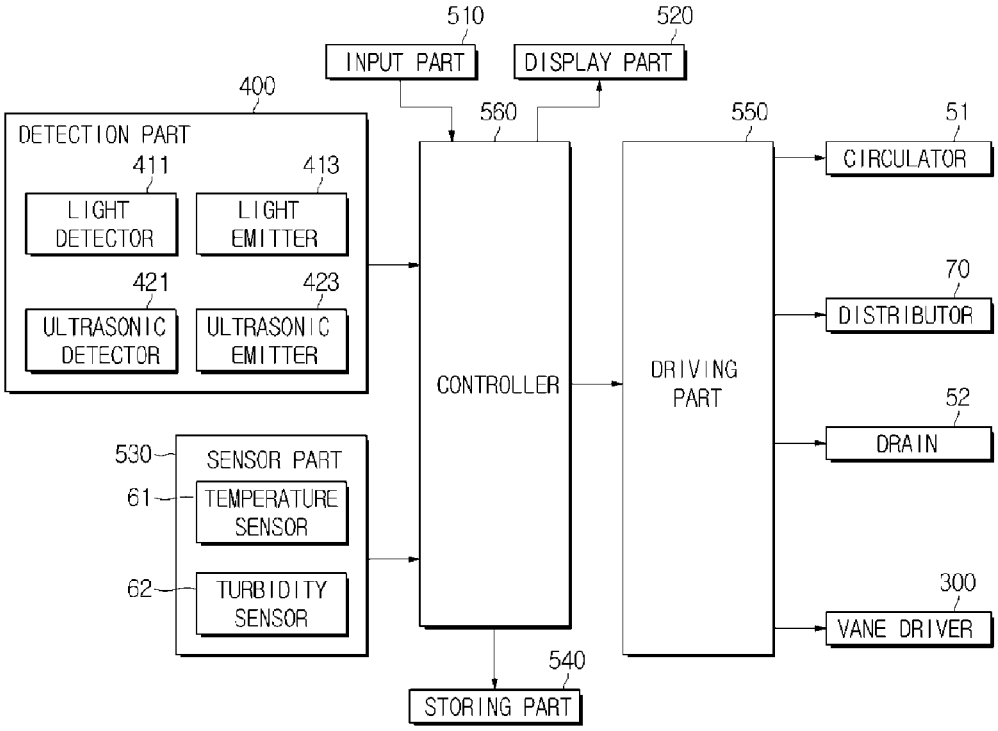
FIG. 9 is a control block diagram for describing the dishwashing machine according to one embodiment in detail.

FIG. 9 is a control block diagram for describing the dishwashing machine according to one embodiment in detail.

With reference to FIG. 9, the dishwashing machine 1 may include an input part 510 for receiving a manipulation instruction, a display part 520 for displaying information related to the dishwashing machine 1, the detection part 400 for detecting tableware, the sensor part 530 for collecting information related to washing water, a storing part 540 for storing the information related to the dishwashing machine 1, a driving part 550 for driving the circulator 51, the distributor 70, the vane driver 300, and the drain 52, and a controller 560 entirely controlling an operation of the dishwashing machine 1.

The detection part 400 detects the tableware. In particular, the detection part 400 detects the tableware at a certain position of the rack 12 and outputs an electrical signal corresponding to the detection. And, based on the electrical signal output from the detection part 400, the controller 560 may determine an accommodation status of the tableware and generate position information thereof. At this point, there is no limitation to the detection part 400 if it is a device capable of detecting an accommodation status of the tableware, and for convenience of description, a light detector 411 detecting the tableware using light and an ultrasonic detector 421 detecting the tableware using an ultrasonic wave will be described as examples.

Also, the detection part 400 may use the vane 200 movable inside the washing tub 20 as described above so as to detect the tableware. As described above, an accommodation status of the tableware at certain each position is detected using the vane 200 to be movable so that the dishwashing machine 1 may detect more exactly the accommodation position of the tableware. As one embodiment, the detection part 400 may detect an accommodation status of the tableware while being moved together with the vane 200. Hereinafter, the detection part 400 of the dishwashing machine according to one embodiment will be described in detail.

The detection part 400 according to one embodiment may be provided inside the vane 200. Therefore, the detection part 400 may be moved by the vane driver 300. As a result, the detection part 400 may be moved together with the vane 200 by the vane driver 300 described above to detect the tableware at each position of the rack 12 of the washing tub 20.

Meanwhile, a plurality of detection parts 400 may be provided at the vane 200. For example, as shown in FIG. 2, a first detector 400*a* for detecting an accommodation status of tableware on a left side of the washing tub 20 and a second detector 400*b* for detecting an accommodation status of the tableware on a right side thereof may be provided to detect the accommodation status of tableware on left and right sides of the rack 12. As described above, the dishwashing machine 1 may be provided with the plurality of detectors 400*a* and 400*b* so that it may detect more precisely a position at which the tableware is accommodated.

At this point, the plurality of detection parts 400 may be preferably provided at the plurality of linear spray parts 100, respectively. For example, with reference to FIGS. 2 and 8, the washing water sprayed from the left linear spray part 110 may be deflected only toward a left zone of the washing tub 20 by the vane 200, and the washing water sprayed from the right linear spray part 120 may be deflected only toward a right zone of the washing tub 20 by the vane 200. In other words, the dishwashing machine 1 may independently perform a divided washing on the left and right sides of the washing tub 20.

Consequently, the dishwashing machine 1 may reduce waste of the washing water, and time required for washing the tableware. Meanwhile, it will be described below that the left linear spray part 110 and the right linear spray part 120 separately spray the washing water, but it is not limited thereto, and it should be understood that the spray part may be subdivided into multiple spray parts as necessary.

The detection part 400 may include the light detector 411 receiving light and detecting an accommodation status of the tableware according to an amount of the received light, and the ultrasonic detector 421 receiving an ultrasonic wave and detecting an accommodation status of the tableware according to a magnitude of the received ultrasonic wave. Hereinafter, with reference to FIGS. 10 and 11, a concrete application example of the detection part 400 will be described in detail.

Figure 10A:
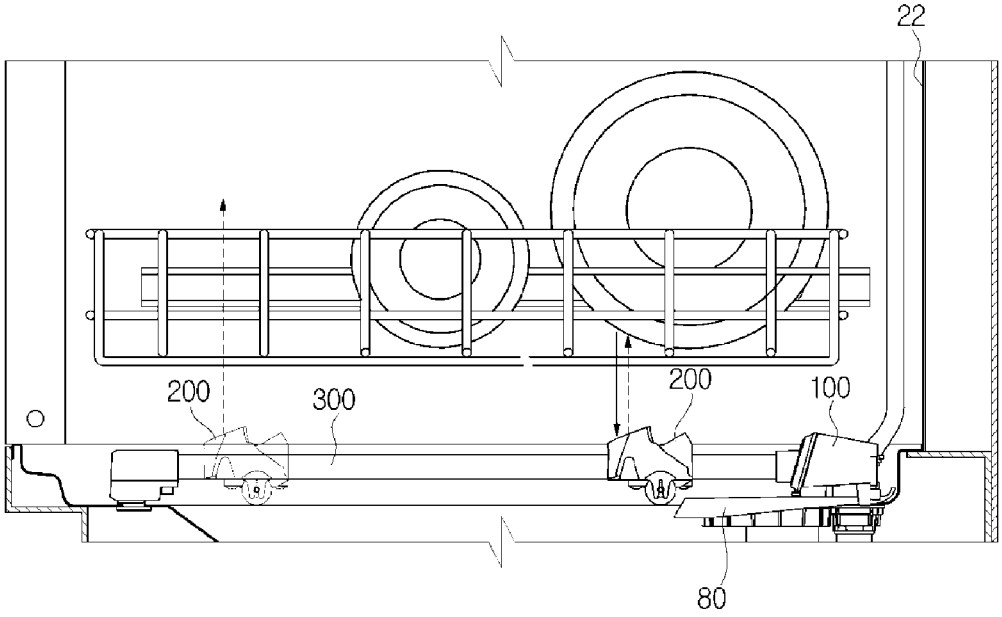
FIGS. 10A, 10B and 10C are diagrams for describing a tableware detection method using light in the dishwashing machine according to one embodiment.
Figure 10B:
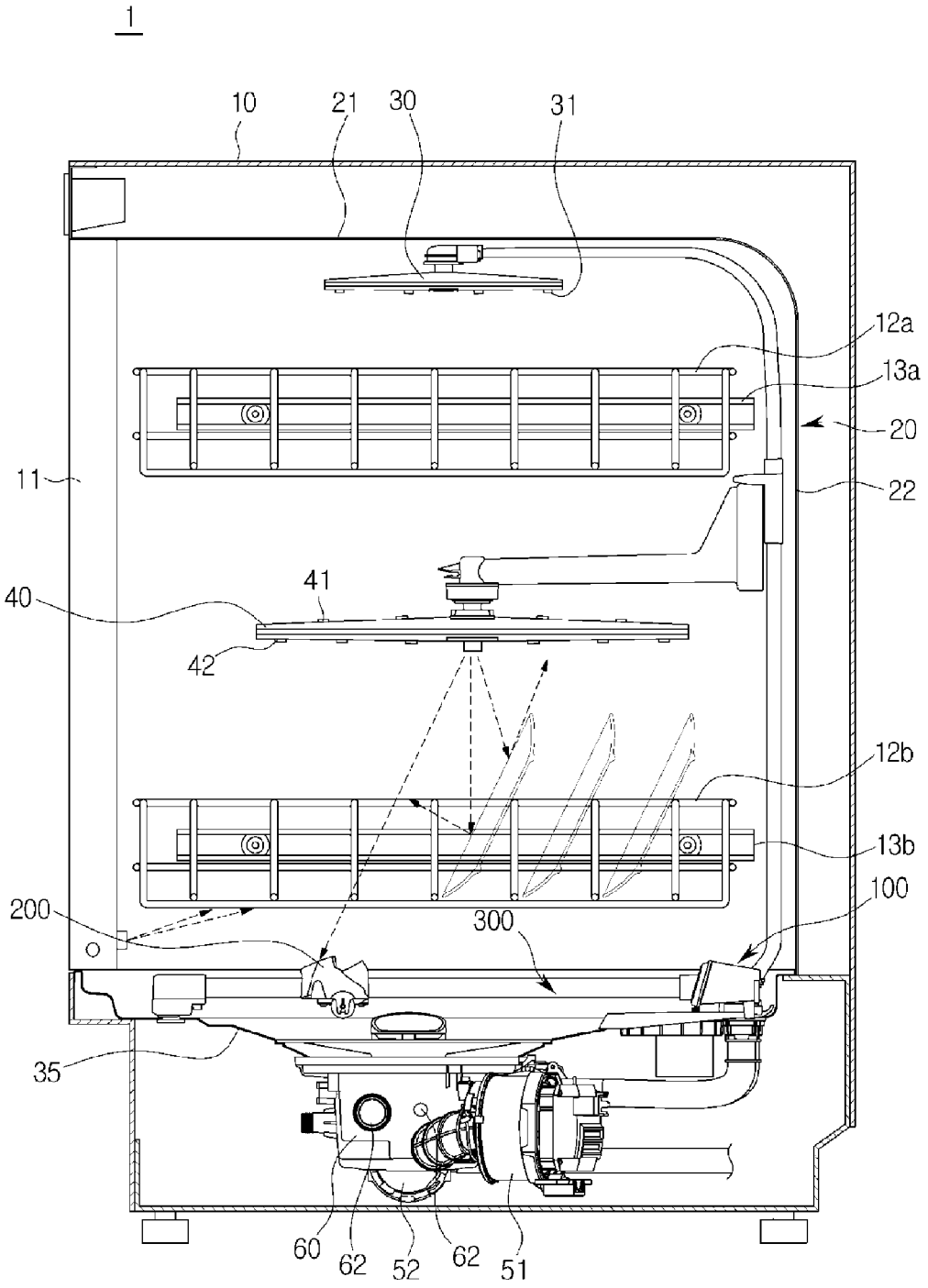
Figure 10C:
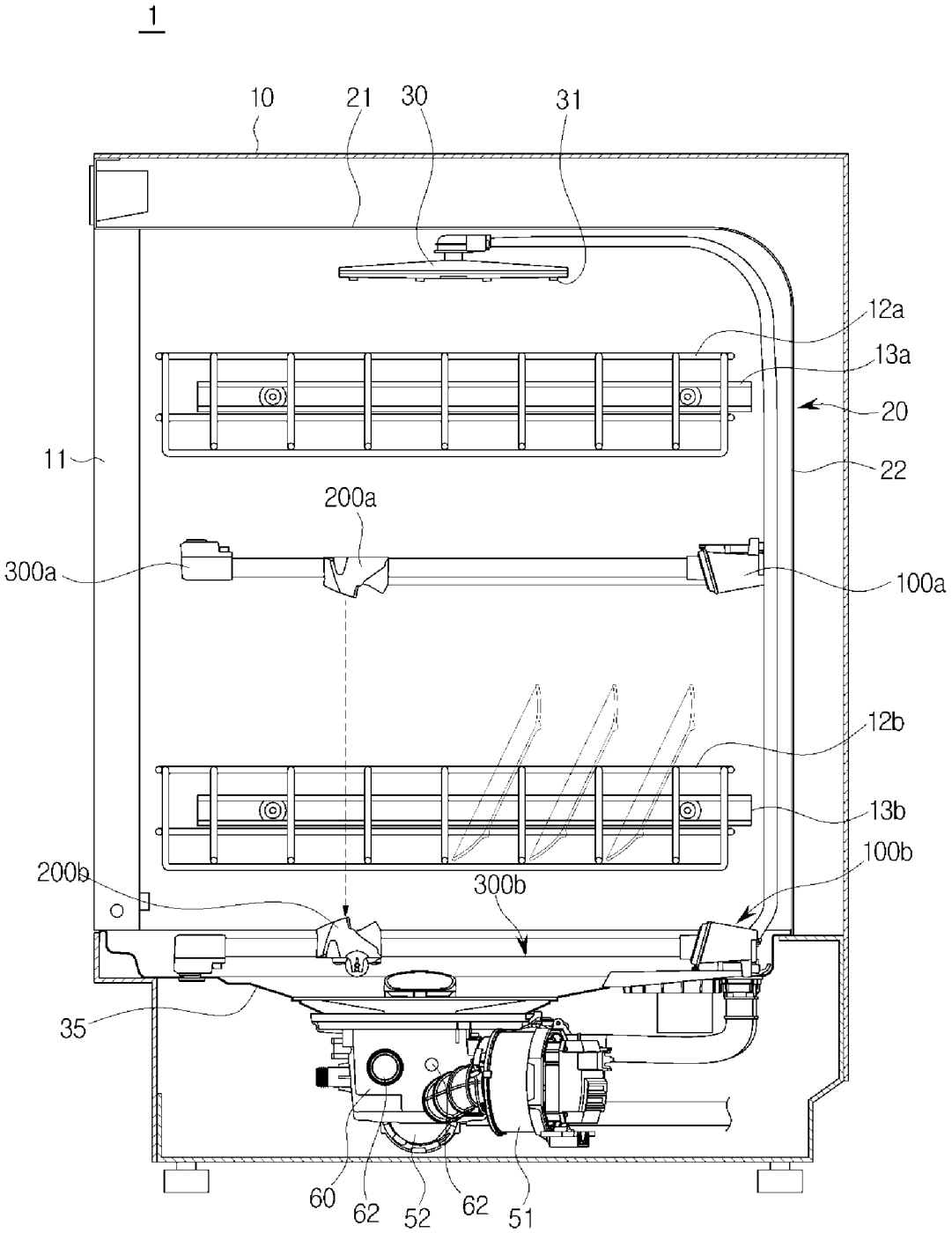

FIGS. 10A, 10B and 10C are diagrams for describing a tableware detection method using light in the dishwashing machine according to one embodiment. The detection part 400 may include the light detector 411 and a light emitter 413.

The light detector 411 may be provided at the vane 200 to detect tableware using light. In particular, the light detector 411 may receive light and output an electrical signal according to an amount of the received light. At this point, the electrical signal may be interpreted by the controller 560 to be used in a generation of position information of the tableware.

At this time, the light detector 411 may be classified into a detector configured with a single type element and a detector configured with a hybrid type element according to a material configuration method.

When a light detector is configured with a single type element, a portion for detecting light and generating an electrical signal and a portion for reading and processing the electrical signal may be configured with a semiconductor of a single material or may be manufactured by a single process, and, for example, a charge coupled device (CCD) or a complementary metal oxide semiconductor (CMOS), which is a light receiving element, may be singly used.

When a light detector is configured with a hybrid type element, a portion for detecting light and generating an electrical signal and a portion for reading and processing the electrical signal may be respectively configured with a different material, or may be respectively manufactured through a different process. For example, the light may be detected using a light receiving element including a photodiode, a CCD, a CdZnTe and the like, and the electrical signal may be read and processed using a CMOS read out integrated circuit (ROIC).

Also, the detection part 400 may further include the light emitter 413 generating and emitting light inside the washing tub 20. To receive light and detect an accommodation status of the tableware in the light detector 411, light being uniformly emitted is needed. Therefore, the detection part 400 may further include the light emitter 413 to emit a uniform light in a predetermined direction inside the washing tub.

Here, the light emitter 413 may be implemented by a semiconductor light emitting device including a laser diode (LD), a light emitting diode (LED), and the like, or a discharge lamp including a halogen lamp or a xenon lamp, and the like. In addition, the light emitter 413 may be implemented by a surface light source having a wide light emitting area so as to uniformly emit light to a predetermined zone. For example, the light emitter 413 may be implemented by a back light unit.

Also, the light emitted from the light emitter 413 may be light having a predetermined wavelength. For example, the light emitted from the light emitter 413 may be laser, infrared ray (IR), or visible light.

As shown in FIG. 10A, the light detector 411 may be moved together with the vane 200 by the vane driver 300 to detect an accommodation status of the tableware. At this point, the light emitter 413 may also be provided at the vane 200 together with the light detector 411.

In particular, while the light detector 411 and the light emitter 413 are moved together with the vane by the vane driver 300, the light emitter 413 may emit light in a direction of the rack 12 and the light detector 411 may receive the light reflected by the tableware and output an electrical signal corresponding to an amount of the received light.

At this point, the light emitted from the light emitter 413 is reflected by the tableware at a position at which the tableware is accommodated, and then is received by the light detector 411. On the other hand, at a position at which the tableware is not accommodated, only the light being indirectly reflected inside the washing tub 20 is incident. That is, according to the accommodation status of the tableware, an amount of light detected by the light detector 411 may be varied.

Therefore, the controller 560 may determine the accommodation status of the tableware based on the electrical signal from the light detector 411, and generate position information of the tableware based on such an electrical signal. In particular, when detecting the tableware, the controller 560 may generate position information of the tableware that the tableware is accommodated at a position of the rack 12 corresponding to a position of the vane 200.

Meanwhile, in FIG. 10B, it is described that the light emitter 413 is located at the vane 200, but a position of the light emitter 413 is not limited thereto, and the light emitter 413 may be located at any position inside the washing tub. For example, as shown in FIG. 10B, the light emitter 413 may be located at the door 11, or may be provided at the middle rotary spray part 40. At this point, the light emitter 413 may alter an emitting direction of light along movement of the vane 200 so as to emit a uniform light.

Also, as shown in FIG. 100, when the dishwashing machine includes a plurality of linear spray parts 100*a* and 100*b* and a plurality of vanes 200*a* and 200*b*, the plurality of vanes 200 may be moved together with each other to detect tableware. For example, as shown in FIG. 10C, the light emitter 413 may be provided at a first vane 200*a* and the light detector 411 may be provided at a second vane 200*b* so that the first vane 200*a* and the second vane 200*b* may be moved together with each other to detect tableware.

Meanwhile, a tableware detection method may be different according to a position of the light emitter 413. For example, as in a case in which the light emitter 413 is located at the middle rotary spray part 40 as shown in FIG. 10B, tableware may be accommodated between the light emitter 413 and the light detector 411. At this point, at a position at which the tableware is accommodated, light emitted from the light emitter 413 is reflected by the tableware not to be incident into the light detector 411. On the other hand, at a position at which the tableware is not accommodated, the light emitted from the light emitter 413 is incident into the light detector 411. Therefore, the controller 560 may differently determine an accommodation status of the tableware according to positions of the light detector 411 and the light emitter 413.

Figure 11:
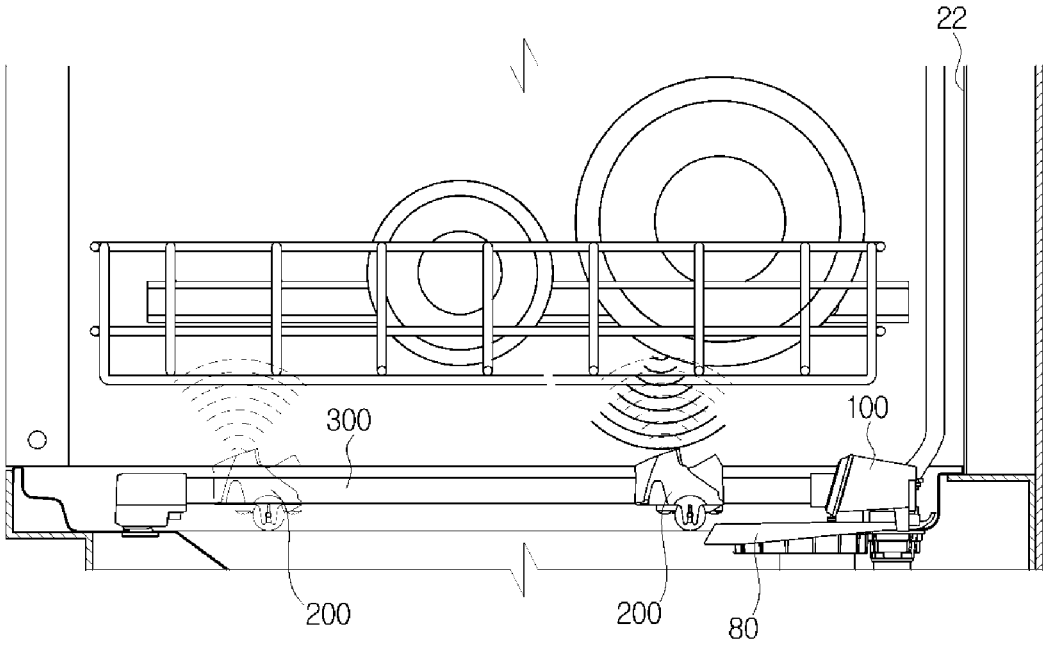
FIG. 11 is a diagram for describing a tableware detection method using an ultrasonic wave in the dishwashing machine according to one embodiment.

FIG. 11 is a diagram for describing a tableware detection method using an ultrasonic wave in the dishwashing machine according to one embodiment.

The detection part 400 may include an ultrasonic emitter 423 and the ultrasonic detector 421.

The ultrasonic detector 421 is provided at the vane 200 to detect tableware using an ultrasonic wave. In particular, the ultrasonic detector 421 may receive an ultrasonic wave and convert the received ultrasonic wave into an electrical signal using an ultrasonic transducer.

At this point, the ultrasonic transducer is a device that converts energy of a certain form into energy of other form, and it may convert electrical energy into wave energy, and vice versa. In particular, the ultrasonic transducer may include a piezoelectric vibrator or a thin film. If an alternating current is applied to the piezoelectric vibrator or the thin film of the ultrasonic transducer from an external electric power supply device or an internal electric capacitor, for example, a power supply including a battery and the like, the piezoelectric vibrator or the thin film is vibrated at a predetermined frequency according to the applied alternating current and then an ultrasonic wave of the predetermined frequency is generated according to the vibration frequency. Contrarily, if an ultrasonic wave of a predetermined frequency is received by a piezoelectric material or the thin film, the piezoelectric material or the thin film is vibrated according to the received ultrasonic wave. At this point, the piezoelectric material or the thin film outputs an alternating current having a frequency corresponding to the vibration frequency.

Here, the ultrasonic transducer may be any one among, for example, a magnetostrictive ultrasonic transducer using a magnetostrictive effect of a magnetic material, a piezoelectric ultrasonic transducer using a piezoelectric effect of a piezoelectric material, and a capacitive micromachined ultrasonic transducer (cMUT) transmitting and receiving an ultrasonic wave using vibration of several hundreds or several thousands of micromachined thin films.

The ultrasonic emitter 423 generates an ultrasonic wave to irradiate the washing tub 20 with the ultrasonic wave. In particular, the ultrasonic emitter 423 may include an ultrasonic transducer converting a pulse signal or an alternating current into vibration energy. In other words, when a pulse signal or an alternating current is input to the ultrasonic transducer by the controller 560, the ultrasonic transducer vibrates according to the pulse signal or the alternating current and generates an ultrasonic wave to irradiate the washing tub 20 with the ultrasonic wave.

In particular, as shown in FIG. 11, the ultrasonic wave received by the ultrasonic detector 421 varies in a magnitude according to an accommodation status of the tableware. In particular, when the tableware is accommodated, the ultrasonic wave is reflected by the tableware to be received by the ultrasonic detector 421, and otherwise, when the tableware is not accommodated, the ultrasonic wave is not reflected to travel in the form of a square wave. Therefore, an electrical signal output from the ultrasonic detector 421 is varied according to the accommodation status of the tableware.

Meanwhile, although the ultrasonic detector 421 and the ultrasonic emitter 423 have been described to be provided at the vane 200 together with each other in FIG. 11, they may be provided at positions different from each other as having been described in FIG. 10. Also, as described above, it should be understood that the controller 560 may differently interpret the electrical signal detected by the ultrasonic detector 421 according to positions of the ultrasonic detector 421 and the ultrasonic emitter 423.

Figure 12A:
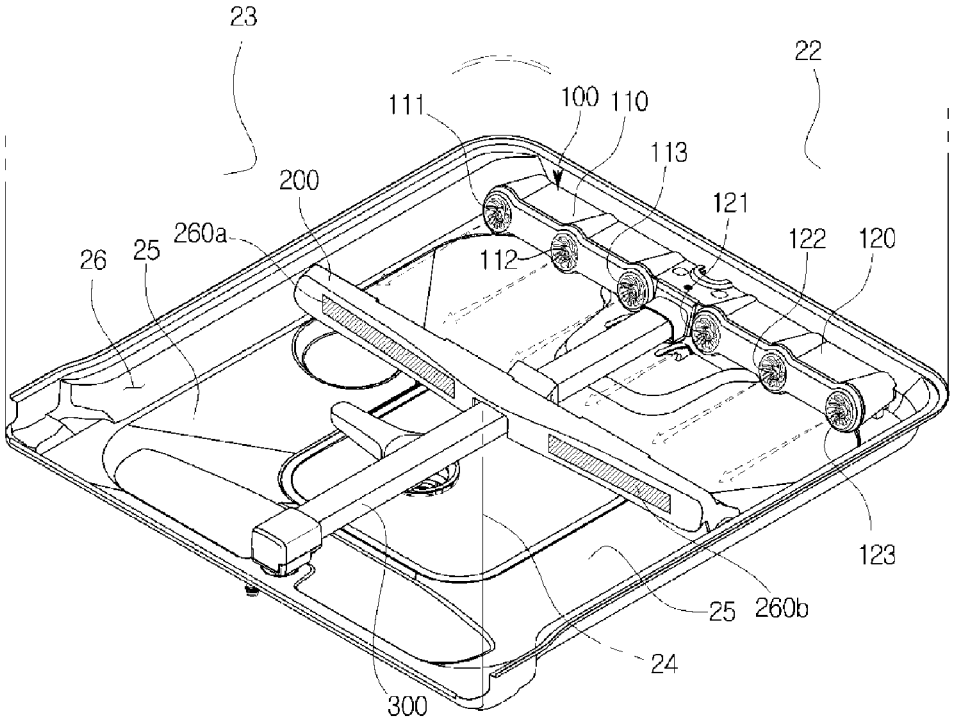
FIGS. 12A and 12B are diagrams for describing a vane according to another embodiment.
Figure 12B:
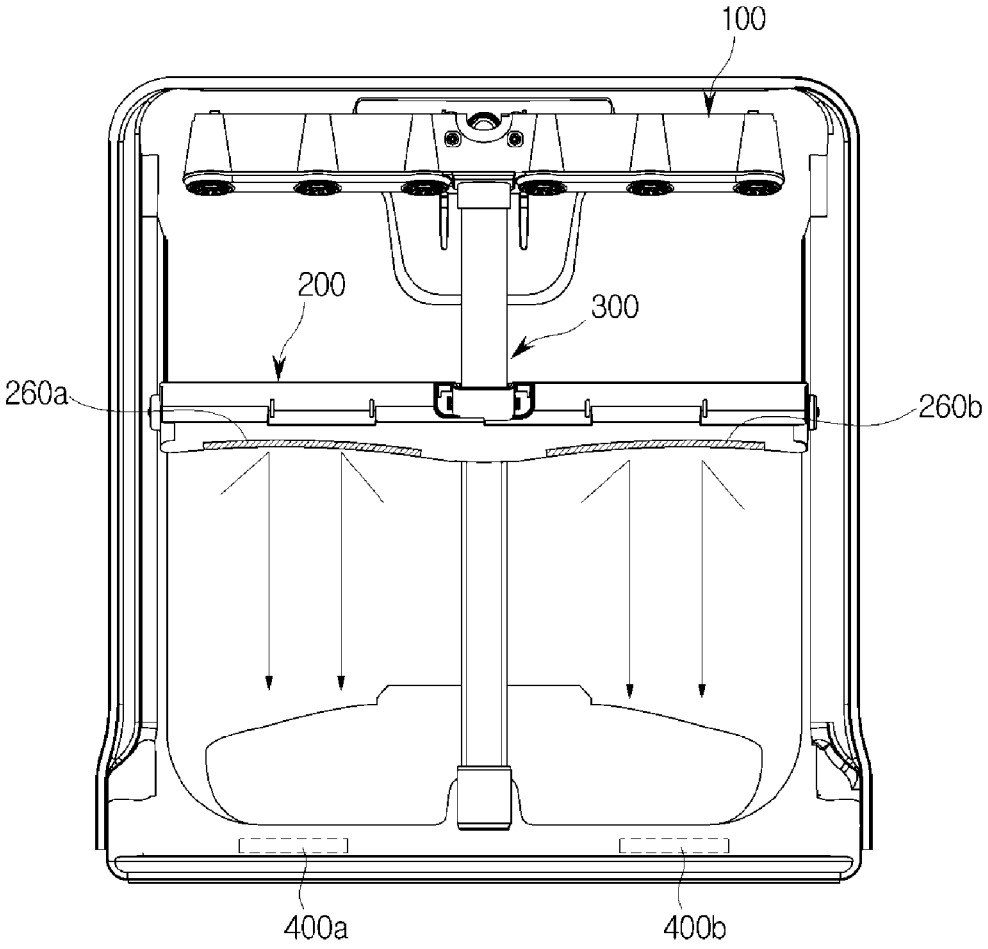
Figure 13A:
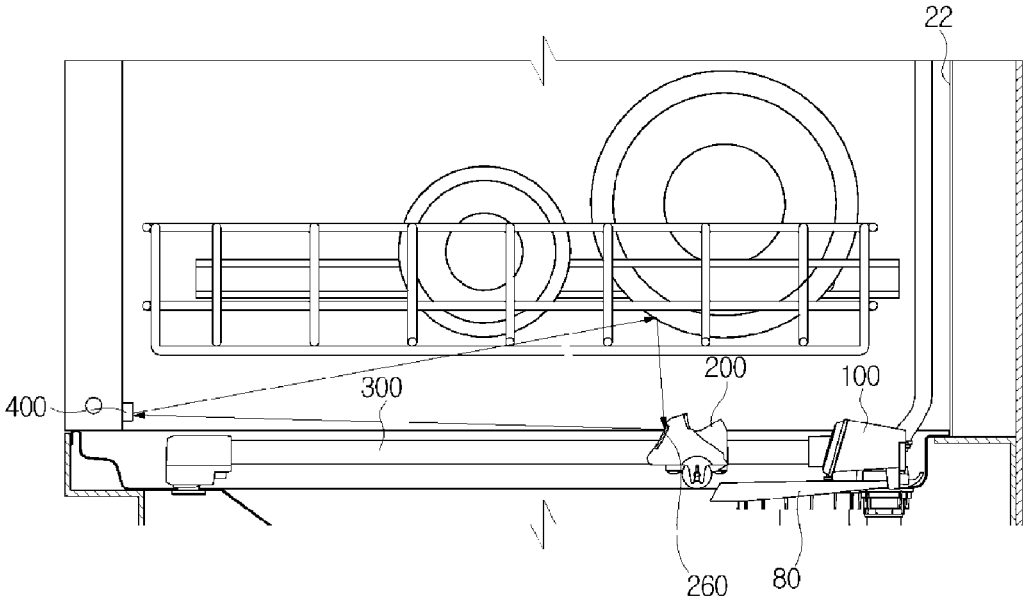
FIGS. 13A and 13B are diagrams for describing a tableware detection method using the vane according to another embodiment.
Figure 13B:
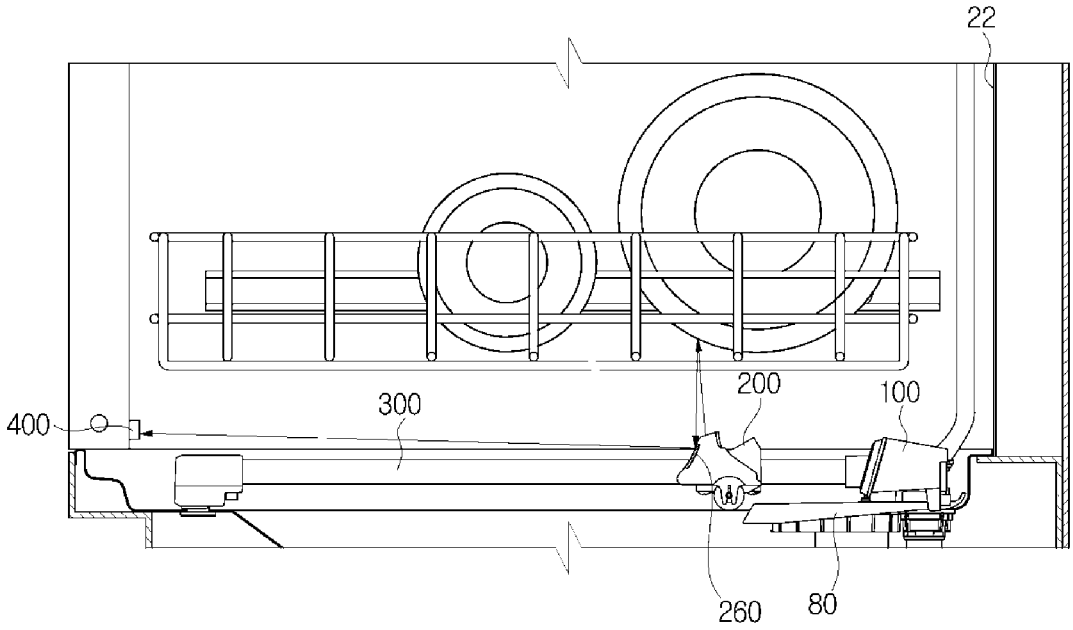

As another embodiment, the detection part 400 may detect an accommodation status of tableware using light or an ultrasonic wave reflected by the vane 200 being moved. FIGS. 12A and 12B are diagrams for describing a vane according to another embodiment. FIGS. 13A and 13B are diagrams for describing a tableware detection method using the vane according to another embodiment.

FIG. 12A is a perspective diagram of a vane according to another one embodiment, and FIG. 12B is a plane diagram of the vane according to another one embodiment. As shown in FIG. 12A, a reflector 260 for reflecting light or an ultrasonic wave may be provided at one side of the vane 200. At this point, a material of a reflector 260*a* may be changed according to the detection part 400. For example, when the detection part 400 is the light detector 411, the reflector may be made of a material such as a mirror that reflects light well. Also, when the detection part 400 is the ultrasonic detector 421, the reflector may be made of a material having high acoustic impedance to reduce a loss of an ultrasonic wave being incident thereto.

In addition, the reflector 260 may be lengthily provided in the length direction of the vane 200, and, as shown in FIG. 12B, it may be formed to have a predetermined curvature to reflect light or an ultrasonic wave being incident thereto toward the detection part 400. Additionally, the reflector 260 may have a predetermined incline as shown in FIGS. 13A and 13B so as to reflect light or an ultrasonic wave toward the detection part 400.

As shown in FIG. 13A, the light detector 411 is spaced apart from the reflector 260 at a predetermined distance and receives the light reflected by the reflector 260 to output an electrical signal according to an amount of the received light. Also, the light detector 411 has been shown in FIGS. 13A and 13B as being provided at the door, but a position of the light detector 411 is not limited thereto, and the light detector 411 may be located at any position inside the washing tub 20. In addition, it should be understood that an incline, a size, a position, and a curvature of the reflector 260 may be changed according to a position of the light detector 421.

Additionally, the light emitter 413 may irradiate light in a direction of the rack in which the tableware can be accommodated and a direction to which the light emitter 413 irradiates the light may be changed according to a position of the vane 200.

As described above, when light generated in the light emitter 413 is irradiated in a predetermined direction, if the tableware is accommodated in the irradiation direction, the light is reflected by the tableware to be incident into the reflector 260, and the detection part 400 detects the light reflected by the reflector 260 to be incident thereinto to generate an electrical signal. On the other hand, if the tableware is not accommodated in the irradiation direction of the light, the light irradiated from the light emitter 413 straightly travels in the irradiation direction so that the light detector 411 does not detect the light. Therefore, the controller 560 may detect the tableware using the electrical signal output from the light detector 411.

Meanwhile, the light emitter 413 may be provided at various positions. For example, the light emitter 413 may be provided at the vane 200 to irradiate light in the direction of the rack 12 as shown in FIG. 13B, or may be provided at the middle rotary spray part 40 to irradiate the light as shown in FIG. 10. At this point, when the tableware is accommodated between the light emitter 413 and the light detector 411, a tableware detection method may be different as described above.

In addition, the ultrasonic detector 421 detecting an ultrasonic wave to detect an accommodation status of the tableware may also detect the tableware through a method the same as or similar to that of the light detector 411 described above.

The sensor part 530 may detect washing water information. At this point, the washing water information may be various information for the washing water including temperature, turbidity and the like.

For this purpose, the sensor part 530 may include a temperature sensor 61 detecting temperature of the washing water. The temperature sensor 61 may be classified into a contact type and a contactless type according to a temperature measurement method. Here, a contact type temperature sensor 61 may directly contact the washing water accommodated in the sump 60 to measure temperature of the washing water when the washing water and the temperature sensor 61 reach a thermal equilibrium state. For example, the contact type temperature sensor 61 may be one among a glass thermometer, a pressure type thermometer, a bimetal thermometer, and a resistance thermometer.

A contactless type temperature sensor 61 detects heat or light output from the washing water to measure a temperature using a relationship between the heat or light and thermal energy in a state not directly contacting the washing water. For example, the contactless type temperature sensor 61 may be one among a radiation thermometer, an optical pyrometer, a color pyrometer, and an infrared thermometer.

Hereinafter, for convenience of description, the temperature sensor 61 will be described as the contact type temperature sensor 61 which is provided in the sump 60 and contacts the washing water accommodated therein to measure temperature of the washing water, but it is not limited thereto.

The sensor part 530 may include a turbidity sensor 62 for sensing turbidity of the washing water. The turbidity sensor 62 may measure turbidity of the washing water. For example, the turbidity sensor 62 may irradiate the washing water accommodated in the sump 60 with light to sense turbidity of the washing water based on an amount of the light passing through the washing water. At this point, the light irradiated from the turbidity sensor 62 to the washing water may be visible light.

For example, as shown in FIG. 3, the temperature sensor 61 and the turbidity sensor 62 may be provided inside the sump 60 and sense temperature and turbidity of the washing water to generate and deliver electrical signals corresponding to the sensed temperature and the sensed turbidity to the controller 560.

The input part 510 may be provided at the front surface of the main body of the dishwashing machine 1 to receive a manipulation instruction for the dishwashing machine 1 from a user. The input part 510 may be, for example, a joystick, a keyboard, a keypad, a touch screen, a track ball, a mouse, a tablet and the like. One among them may be used as the input part 510, and at least two thereamong may be combined to configure the input part 510.

The display part 520 may display various information related to the dishwashing machine 1. For example, the display part 520 may display information including a washing progress status of the dishwashing machine 1, a remaining time until the washing is completed, and the like. At this point, the display part 520 may be implemented by, for example, a liquid crystal display (LCD), a light emitting diode (LED), an organic light emitting diode (OLED), an active matrix organic light emitting diode (AMOLED), a flexible display, a 3-dimensional display and the like.

Meanwhile, when being implemented by a touch screen, the display part 520 may additionally perform a function of the input part 510.

The storing part 540 may include a non-volatile memory (not shown) including a magnetic disc, a solid state disk and the like for permanently storing programs and data for controlling an operation of the dishwashing machine 1, and a volatile memory (not shown) including a dynamic random access memory (DRAM), a static RAM (SRAM) and the like for temporarily storing temporary data generated in a course of controlling the operation of the dishwashing machine 1.

The driving part 550 drives each of components included in the dishwashing machine 1 according to a control signal of the controller 560, which will be described later. In particular, the driving part 550 may include a driving circuit generating a driving current that drives the circulator 51 supplying washing water, the distributor 70 distributing the washing water, the vane driver 300 moving the vane 200 for deflecting the washing water, and the drain 52 discharging the washing water. For example, the driving part 550 may include an H-bridge circuit so as to drive the vane driver 300 that moves the vane 200 in both directions.

The controller 560 controls an operation of each of the components included in the dishwashing machine 1. At this point, the controller 560 may correspond to a single processor or a plurality of processors. Here, the processor may be implemented by an array of a plurality of logic gates, and by a combination of a multi-purpose microprocessor and a memory storing a program executable in the multi-purpose microprocessor. Also, it can be understood by those skilled in the art that the processor may be implemented by hardware of other form.

In particular, the controller 560 controls the driving part 550 to drive each of the components included in the dishwashing machine 1 according to the manipulation instruction of the user, which is input through a manipulation part. Also, the controller 560 may generate position information of the tableware, and control each of the components so as to intensively spray the washing water toward a position at which the tableware is accommodated based on the generated position information of the tableware. At this point, the position information of the tableware represents the position at which the tableware is accommodated in the rack 12. Hereinafter, a tableware washing process will be described in detail.

The dishwashing machine 1 may compositively perform a plurality of cycles to wash the tableware. For example, the tableware may be washed through a position information generation cycle, a water supply cycle, a washing cycle, a draining cycle, and a drying cycle, and the controller 560 may control each of the components to perform each cycle.

Figure 14A:
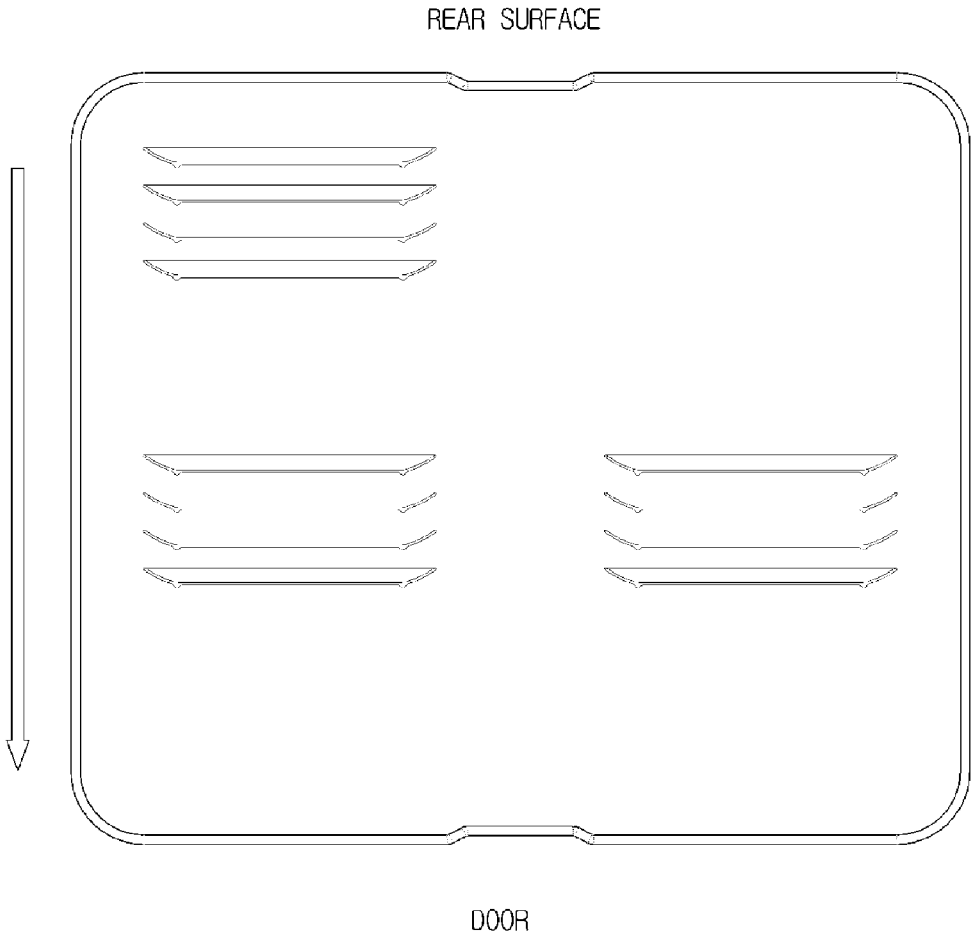
FIGS. 14A and 14B are diagrams for describing position information in detail.

In the position information generation cycle, the vane 200 is moved by the vane driver 300. At this point, the detection part 400 detects the tableware while the vane 200 is moved and outputs an electrical signal. When the tableware is detected by the detection part 400, the controller 560 generates the position information of the tableware based on a position of the vane 200. In particular, when the tableware is accommodated in the rack 12 as shown in FIG. 14A, the vane 200 and the detection part 400 may be moved in an arrow direction to detect an accommodation status of the tableware at each position. As described above, the tableware accommodated in the rack 12 reflects light or an ultrasonic wave so that the lights or the ultrasonic waves detected at positions at which the tableware is accommodated or not are different from each other.

Consequently, as described above, the tableware may be detected according to the output signal output from the detection part 400. In particular, the controller 560 may compare a reference signal with the electrical signal output from the detection part 400 to determine an accommodation status of the tableware. At this point, the reference signal may be an electrical signal output from the detection part 400 at a position at which the tableware is not accommodated, or an electrical signal output therefrom at a position at which the tableware is accommodated. Hereinafter, for convenience of description, it will be described that the reference signal is the electrical signal output from the detection part 400 at a position at which the tableware is not accommodated.

Therefore, when the tableware is accommodated as shown in FIG. 12A and the vane 200 is located at positions corresponding to zones A and B at which the tableware is accommodated, an electrical signal output from the detection part 400 is different from a reference signal. Consequently, as shown in FIG. 12B, the controller 560 may generate position information of the tableware that the tableware is located at the zones A and B at which the reference signal and the electrical signal output from the detection part 400 are different from each other.

Meanwhile, the position information generation cycle described above is a description of one embodiment for generating position information of the tableware, and it is not limited thereto. For example, the controller 560 may generate an internal image of the washing tub 20 based on the electrical signal output from the light detector 411, and generate position information of the tableware that the tableware is accommodated at a position at which the generated image and a reference image are different from each other. At this point, the reference image may be an image obtained in a state that no tableware is accommodated. Also, for this purpose, the light detector 411 may be configured with a plurality of pixels and each pixel may receive light and output an electrical signal according to an amount of the received light.

In the water supply cycle, washing water may be supplied inside the washing tub 20 through a water supply pipe (not shown). The washing water supplied to the washing tub 20 may flow into the sump 60 provided at the lower portion of the washing tub 20 due to an incline of the bottom plate 35 of the washing tub 20 to be stored in the sump 60.

In the washing cycle, the washing water sprayed from the spray parts 30, 40, and 100 hits the tableware, washes waste residing on the tableware, and drops together with the waste to be stored again in the sump 60. The circulator 51 pumps again and circulates the washing water stored in the sump 60. During the washing cycle, the circulator 51 may repeat a running and a stopping many times. In such a process, the waste dropped into the sump 60 together with the washing water is collected by a filter mounted at the sump 60 to be stayed therein without being circulated to the spray parts 30, 40, and 100.

At this point, the washing water pumped by the circulator 51 may be distributed to the rotary spray parts 30 and 40, the left linear spray part 110, and the right linear spray part 120 through the distributor 70. At this point, the distributor 70 may adjust the washing water to be distributed to only a selected hose among the plurality of hoses 71*a*, 71*b*, and 71*c*.

In particular, during the washing cycle, while being linearly moved by the vane driver 300, the vane 200 deflects the washing water sprayed from the linear spray part 100 in the direction of the tableware. At this point, the movement of the vane 200 may be determined by the controller 560. As one embodiment, on the basis of the position information of the tableware, the controller 560 may slowly move the vane 200 at a position at which the tableware is accommodated so as to intensively spray the washing water toward that position, and otherwise, it may rapidly move the vane 200 at a position at which the tableware is not accommodated.

As another embodiment, on the basis of the position information of the tableware, the controller 560 may stop the vane 200 at the position at which the tableware is accommodated so as to intensively spray the washing water toward that position.

Also, the distributor 70 may adjust the hoses 71*a*, 71*b*, and 71*c* to which the washing water is to be supplied, under the control of the controller 560. At this point, a selection of the hoses 71*a*, 71*b*, and 71*c* to which the washing water is to be supplied may be made according to the position information of the tableware. For example, when the tableware is accommodated in only a left zone like the zone A shown in FIG. 14B, the washing water sprayed from the right linear spray part 120 does not wash the tableware even though being deflected by the vane 200. Therefore, when the vane 200 is located at a position corresponding to the zone A, the washing water may not be supplied to the second hose 71*c* so as not to spray the washing water from the right linear spray part 120.

Also, during the washing cycle, the controller 560 may control the movement of the vane 200 based on washing water information sensed by the sensor part 530. At this point, the washing water information may be information related to the washing water including temperature, turbidity and the like.

In particular, temperature of the washing water is varied as the washing water is rubbing against tableware being accommodated. That is, according to the zeroth law of thermodynamics, heat of the washing water is transferred to the tableware and thus the washing water losses heat as much as the heat transferred to the tableware. At this point, as a size of the tableware is increased, a heat loss of the washing water is also increased. Therefore, the controller 560 may determine a size of the tableware accommodated at each position based on the temperature sensed at the temperature sensor 61, and control the movement of the vane 200 so as to spray the washing water in proportion to the size of the tableware. As described above, the movement of the vane 200 is determined according to a temperature variation of the washing water so that the tableware accommodated in the dishwashing machine 1 may be washed more efficiently.

In addition, turbidity of the washing water may be varied according to a contamination degree of the tableware. In other words, when the contamination degree of the tableware is high, turbidity of the washing water after washing the tableware is increased. Therefore, the controller 560 may determine a contamination degree of each of the tableware using the turbidity sensor 62, and control the movement of the vane 200 so as to spray the washing water in proportion to the turbidity of the tableware. As described above, the movement of the vane 200 is determined according to a turbidity variation of the washing water so that the tableware accommodated in the dishwashing machine 1 may be washed more efficiently.

As described above, the linear spray part 100 spraying the washing water and the movement of the vane 200 are controlled to intensively spray the washing water toward the position at which the tableware is accommodated so that the washing water may be intensively sprayed toward the tableware to efficiently wash the tableware.

Also, a movement speed of the vane 200 may be controlled according to position information of the tableware so that a tableware washing time may be shortened. In addition, a position at which the washing water is sprayed may be controlled according to the position information of the tableware so that waste of the washing water may be prevented.

During the draining cycle, the drain 52 may be driven to drain waste residing in the sump 60 together with the washing water therein into the external side of the main body 10.

In the drying cycle, a heater (not shown) mounted at the washing tub 20 may be driven to dry the tableware.

Meanwhile, the dishwashing machine has been described to wash the tableware by performing the position information generation cycle, the water supply cycle, the washing cycle, the draining cycle, and the drying cycle, but is not limited thereto. For example, each cycle may be simultaneously performed, and an additional cycle for washing the tableware may be added.

Figure 15:
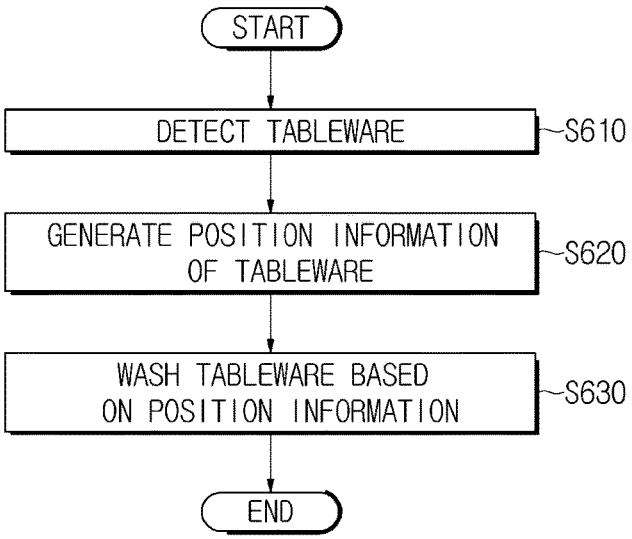
FIG. 15 is a flowchart for describing a control method of the dishwashing machine in one embodiment.

FIG. 15 is a flowchart for describing a control method of the dishwashing machine according to one embodiment.

As shown in FIG. 15, the detection part 400 may detect tableware in Operation 610. At this point, the vane 200 may be moved inside the washing tub 20 by the vane driver 300, and the detection part 400 may detect an accommodation status of the tableware at a position corresponding to a position of the vane 200 using light or an ultrasonic wave.

In other words, as described above, the detection part 400 may receive light irradiated from the light emitter 413, light reflected by the tableware, or light reflected by the reflector 260 to output an electrical signal according to an amount of the received light, or receive ultrasonic wave irradiated from the ultrasonic emitter 423, an ultrasonic wave reflected by the tableware, or an ultrasonic wave reflected by the reflector 260 to output an electrical signal corresponding to the received ultrasonic wave.

The controller 560 generates position information of the tableware based on the electrical signal output from the detection part 400 in Operation 620. In particular, when the electrical signal output from the detection part is different from a reference signal, the controller 560 may determine that the tableware is accommodated at a position corresponding to the vane 200 to generate the position information of the tableware. As described above, the position information of the tableware may be generated based on the movement of the vane 200 so that a position of the tableware may be determined more exactly.

As another embodiment, the controller 560 may generate an image inside the washing tub 20 based on the electrical signal output from the light detector 411, and generate position information of the tableware that the tableware is accommodated at a position at which the generated image and a reference image are different from each other. At this point, the reference image may be an image obtained when no tableware is accommodated.

The controller 560 washes the tableware based on the position information of the tableware in Operation 630. The controller 560 may control to intensively spray the washing water toward the position at which the tableware is accommodated based on the position information of the tableware. As described above, the washing water may be sprayed based on the position information of the tableware so that the tableware may be washed more effectively.

In particular, for washing the tableware, while moving in forward and backward directions, the vane 200 deflects the washing water sprayed from the linear spray part 100. At this point, for efficiently washing the tableware, the controller 560 may sense a size, turbidity, or the like of the tableware using the sensor part 530 and adjust a spray amount of the washing water according to the size and turbidity of the tableware. Hereinafter, one embodiment of a spray amount adjustment of the washing water will be described.

Figure 16:
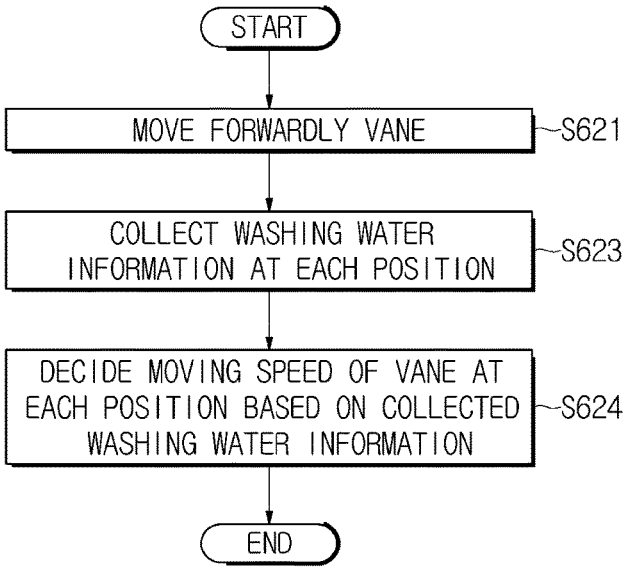
FIG. 16 is a flowchart for describing one embodiment of an adjustment of a spray amount of the washing water.

FIG. 16 is a diagram for describing one embodiment of a spray amount adjustment of the washing water. As described above, while moving in the forward and backward directions, the vane 200 deflects the washing water toward a predetermined direction. Therefore, an amount of the washing water sprayed at each position may be adjusted by a moving speed of the vane 200. With reference to FIG. 16, one embodiment of adjusting a spray amount of the washing water by determining a moving speed of the vane 200 will be described in detail.

As shown in FIG. 16, the vane 200 may be forwardly moved in a direction of the door in Operation 621. At this point, the washing water sprayed from the linear spray part 100 is deflected toward a direction in which tableware is accommodated by the vane 200 being forwardly moved. As described above, the washing water deflected toward the tableware is dropped together with waste on the tableware into the lower surface of the washing tub 20 to flow into the sump 60.

The sensor part 530 may detect washing water information related to the washing water flowing inside the sump 60 in Operation 623. At this point, the washing water information may be temperature, turbidity, or the like of the washing water.

The controller 560 may determine a moving speed of the vane 200 based on the collected washing water information in Operation 624. As described above, temperature of the washing water may be varied according to a size of the tableware, and turbidity of the washing water may be varied according to a contamination degree of the tableware. Therefore, the controller 560 may determine that large-sized tableware is accommodated at a position at which a temperature variation of the washing water is greater, thereby deciding a moving speed of the vane 200 to a relatively slow speed, and otherwise, it may determine that small-sized tableware is accommodated at a position at which the temperature variation is less, thereby deciding the moving speed of the vane 200 to a relatively fast speed.

Also, turbidity of the washing water is varied according to a contamination degree of the tableware. Therefore, the controller 560 may determine that tableware of a high contamination degree is located at a position at which a turbidity variation of the washing water is greater, thereby deciding the moving speed of the vane 200 to a slow speed, and otherwise, it may determine that tableware of a low contamination degree is accommodated at a position at which the turbidity variation of the washing water is less, thereby deciding the moving speed of the vane 200 to a fast speed.

Figure 17:
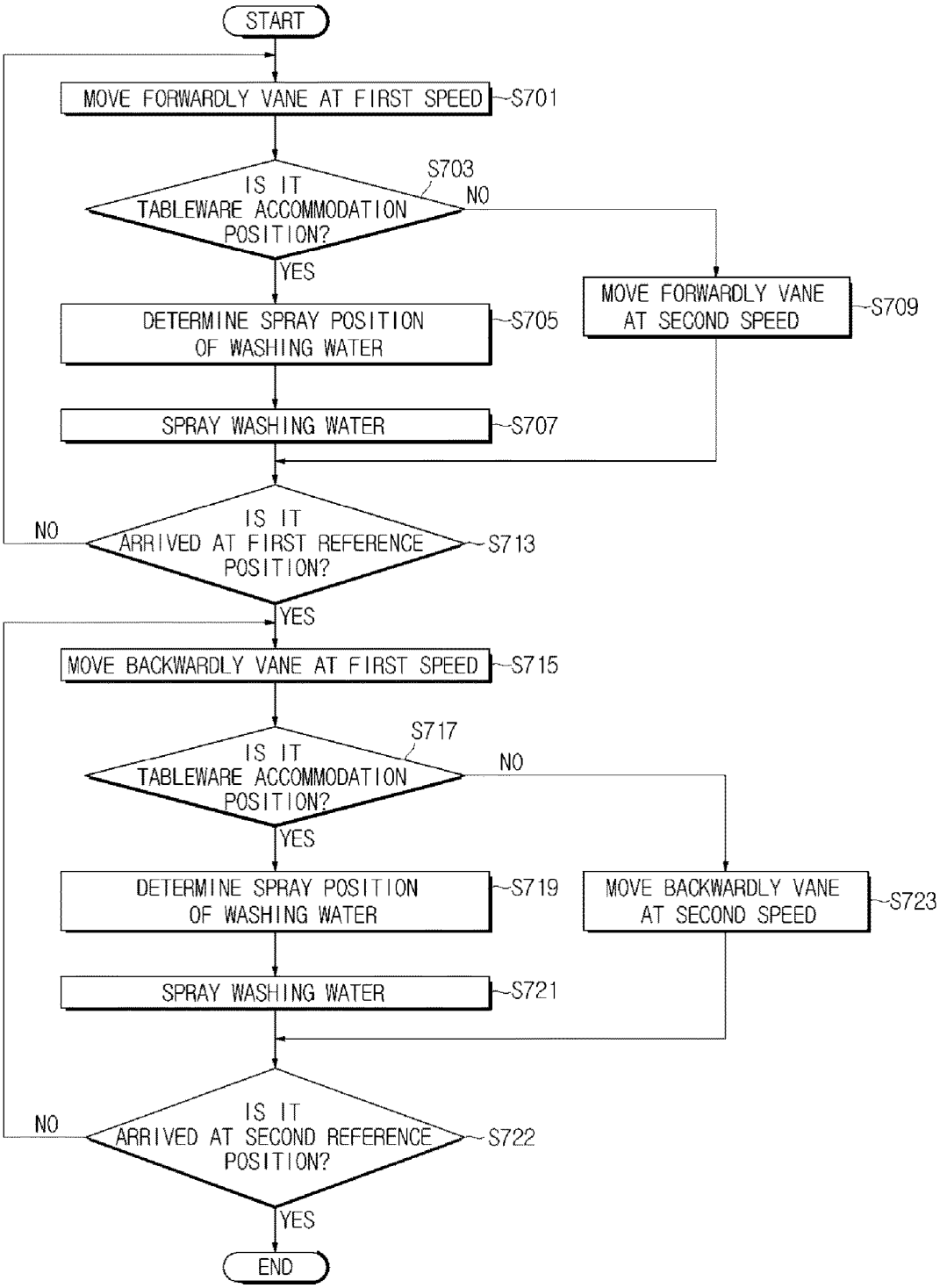
FIG. 17 is a flowchart for describing Operation 630 of FIG. 15 in detail.

FIG. 17 is a flowchart for describing Operation 630 of FIG. 15 in detail.

As shown in FIG. 17, the vane 200 may be forwardly moved (in a direction at which the door is provided) at a first speed in Operation 701, and the controller 560 may determine whether or not a position of the vane 200 is a position at which the tableware is accommodated in Operation 703. For this purpose, the dishwashing machine 1 may be provided with various configurations capable of sensing a position of the vane 200.

When the position of the vane 200 is the position at which the tableware is accommodated (YES of Operation 703), the controller 560 may determine a spray position of the washing water based on the position information of the tableware in Operation 705, and control the distributor 70 to spray the washing water toward only the determined spraying position in Operation 707. For example, like the zone A shown in FIG. 14B, when the vane 200 is located at a position at which the tableware is accommodated in only a left side, the controller 560 may determine that the washing water is sprayed only from the left linear spray part 110, and control the distributor 70 to spray the washing water only from the left linear spray part 110.

On the other hand, when the position of the vane 200 is not the position at which the tableware is accommodated (NO of Operation 703), the controller 560 may forwardly move the vane 200 at a second speed in Operation 709. At this point, the second speed is faster than the first speed. In addition, the controller 560 may control the distributor 70 not to spray the washing water.

Figure 14B:
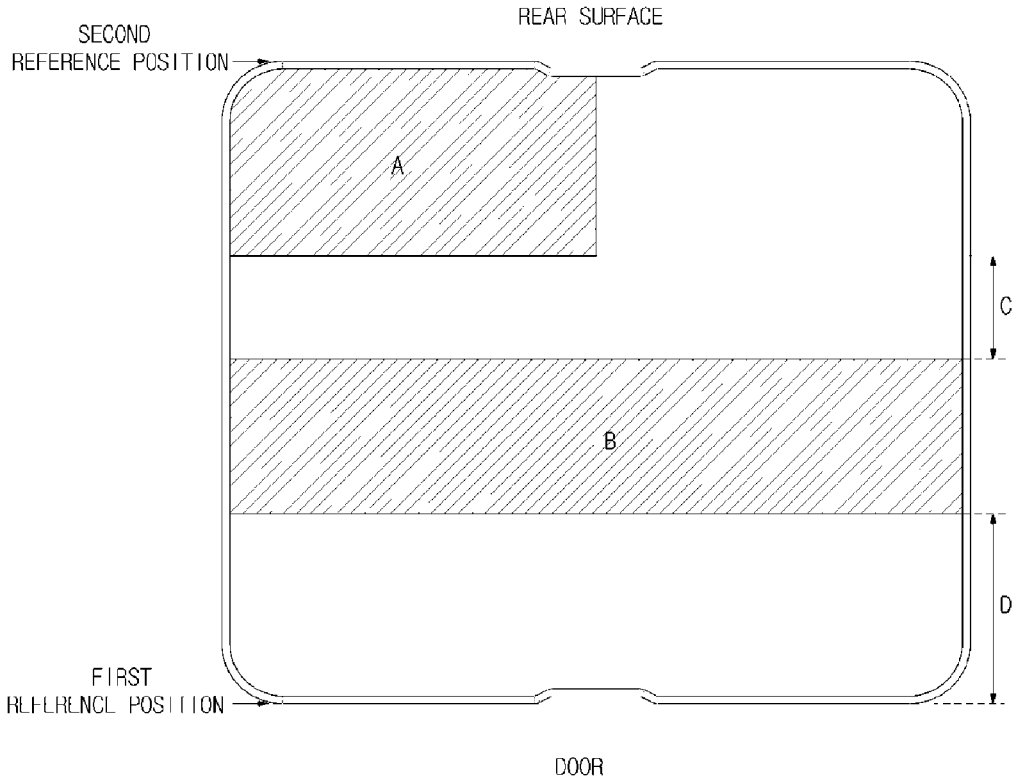

For example, as shown in FIGS. 14A and 14B, when the vane 200 is located at a position corresponding to a position C at which the tableware is not accommodated, the dishwashing machine 1 may be forwardly moved at the second speed without spraying the washing water. The vane 200 may be moved at a fast speed over the position at which the tableware is not located such that a tableware washing time may be shortened.

The controller 560 determines whether or not the vane 200 is arrived at a position corresponding to a first reference position in Operation 713, and, if the vane 200 is not arrived at the first reference position (NO of Operation 712), the controller 560 forwardly moves again the vane 200 at the first speed in Operation 701. At this point, the first reference position may be a final position at which the vane 200 can be forwardly moved to reach finally. However, the first reference position is not limited thereto, and, for example, a boundary between B and C being the final position at which the tableware is accommodated may be the first reference position as shown in FIG. 14B.

Meanwhile, when being arrived at the position corresponding to the first reference position (YES of Operation 713), the vane 200 may be backwardly moved (in a reverse direction at which the door is provided) at the first speed in Operation 715, and the controller 560 may determine whether or not the position of vane 200 is the position at which the tableware is accommodated in Operation 717.

When the position of the vane 200 is the position at which the tableware is accommodated (YES of Operation 717), the controller 560 may determine a spray position of the washing water based on the position information of the tableware in Operation 719, and control the distributor 70 to spray the washing water toward only the determined spraying position in Operation 721.

On the other hand, when the position of the vane 200 is not the position at which the tableware is accommodated (NO of Operation 717), the controller 560 may backwardly move the vane 200 at the second speed in Operation 723. At this point, the second speed is faster than the first speed. In addition, the controller 560 may control the distributor 70 not to spray the washing water.

The controller 560 determines whether or not the vane 200 is arrived at a position corresponding to a second reference position in Operation 727, and, if the vane 200 is not arrived at the second reference position (NO of Operation 727), the controller 560 backwardly moves again the vane 200 at the first speed in Operation 715. At this point, the second reference position is a final position at which the vane 200 can be backwardly moved to reach finally. However, the second reference position is not limited thereto. On the other hand, when the vane 200 is arrived at the second reference position (YES of Operation 727), Operation is terminated.

The invention claimed is:

1. A dishwashing machine comprising:

at least one spray part configured to spray washing water;

a vane configured to perform a movement along a spray direction of the washing water, and deflect the sprayed washing water toward tableware;

a rack configured to accommodate the tableware to be washed by the washing water deflected by the vane;

a detection part installed at the vane and configured to detect the tableware accommodated in the rack, wherein the at least one spray part includes a linear spray part and the linear spray part includes a left linear spray part having a plurality of spray holes and a right linear spray part having a plurality of spray holes, and a controller configured to generate position information with respect to the tableware while the vane performs the movement, determine whether to spray the washing water through only the left linear spray part, or through only the right linear spray part, or through both the left linear spray part and the right linear spray part, based on the position information, and control the movement of the vane based on the position information so as to enable the sprayed washing water to be deflected toward a position at which the tableware is accommodated.

2. The dishwashing machine of claim 1, wherein the detection part includes a light detector configured to receive light irradiated from a light emitter or reflected by the tableware.

3. The dishwashing machine of claim 2, wherein the controller is further configured to generate the position information with respect to the tableware based on a position at which an amount of the light irradiated from the light emitter or reflected by the tableware is equal to or greater than a reference amount of light, and wherein the amount of the light is detected by the light detector.

4. The dishwashing machine of claim 2, wherein the controller is further configured to generate an image of the rack based on an amount of the light detected by the light detector, and generate the position information with respect to the tableware based on a position at which the generated image and a reference image are different from each other, wherein the reference image is an image obtained in a state that no tableware is accommodated.

5. The dishwashing machine of claim 1, wherein the detection part includes an ultrasonic detector and configured to detect an ultrasonic wave irradiated from an ultrasonic emitter or reflected by the tableware.

6. The dishwashing machine of claim 5, wherein the controller is further configured to generate the position information by comparing the ultrasonic wave with a reference ultrasonic wave.

7. The dishwashing machine of claim 1, wherein, the controller is further configured to determine that tableware is accommodated in the position of the rack corresponding to the position of the vane when the detection part detects the tableware being accommodated, and generate the position information with respect to the tableware based on the position of the rack.

8. The dishwashing machine of claim 1, further comprising:

a temperature sensor configured to measure a temperature of the washing water, wherein the controller is further configured to control the movement of the vane based on a variation of the temperature.

9. The dishwashing machine of claim 1, further comprising:

a turbidity sensor configured to measure turbidity of the washing water, wherein the controller is further configured to control the movement of the vane based on the turbidity of the washing water.

10. The dishwashing machine of claim 9, wherein the controller is further configured to determine a contamination degree of the tableware depending on the turbidity of the washing water, and decide a moving speed of the vane in response to the contamination degree.

11. The dishwashing machine of claim 1, wherein the controller is further configured to intensively spray the washing water toward the position at which the tableware is accommodated based on the position information.

* * * * *